US007270869B2

(12) United States Patent
Goto et al.

(10) Patent No.: US 7,270,869 B2
(45) Date of Patent: Sep. 18, 2007

(54) IMAGE-RECORDING MATERIAL, PROCESS FOR PRODUCING THE SAME AND PROCESS FOR FORMING IMAGE

(75) Inventors: Yasutomo Goto, Shizuoka (JP); Yoshio Tani, Shizuoka (JP); Hiroshi Kajimaru, Kyoto (JP)

(73) Assignee: FUJIFILM Corporation, Tokyo (JP)

( * ) Notice: Subject to any disclaimer, the term of this patent is extended or adjusted under 35 U.S.C. 154(b) by 421 days.

(21) Appl. No.: 10/893,905

(22) Filed: Jul. 20, 2004

(65) Prior Publication Data

US 2005/0019583 A1 Jan. 27, 2005

(30) Foreign Application Priority Data

Jul. 25, 2003 (JP) ..... 2003-201997

(51) Int. Cl.
*B41M 5/00* (2006.01)

(52) U.S. Cl. ..... 428/195.1; 503/200; 503/227; 428/32.1; 428/32.6; 430/211

(58) Field of Classification Search ..... None
See application file for complete search history.

(56) References Cited

U.S. PATENT DOCUMENTS

2002/0068165 A1* 6/2002 Tani et al. ..... 428/327
2003/0235683 A1* 12/2003 Tamagawa et al. ..... 428/195.1
2004/0229044 A1* 11/2004 Goto ..... 428/421
2005/0002704 A1* 1/2005 Nakamura et al. ..... 399/341

FOREIGN PATENT DOCUMENTS

JP 5-214269 A 8/1993

OTHER PUBLICATIONS

Kitahara, Fumio, "Clarification of Dispersion and Flocculation and Applied Technology", (*Bunsan Gyoshu no kaimei to Ohyogijyutsu* in Japanese, Chapter 8-2-1 to 8-2-2, Techno System Ltd., 1992, Japan, pp. 450-452.

* cited by examiner

*Primary Examiner*—Rena Dye
*Assistant Examiner*—David J. Joy
(74) *Attorney, Agent, or Firm*—Sughrue Mion pllc.

(57) ABSTRACT

The object of the present invention is to provide an image-recording material that may prevent a flocculation of a coating liquid for image-recording layer that contains a water-dispersible emulsion and a water-soluble polymer compound, and that may exhibit an enhanced stability, present an improved film-forming performance, and provide superior surface conditions. In order to achieve the object, an image-recording material according to the present invention is provided, in which the image-recording material comprises a support and at least one image-recording layer on the support, wherein the image-recording layer is formed from a water-dispersible emulsion of which volume-average particle size is 55 nm or more and a water-soluble polymer compound of which weight-average molecular weight (Mw) is 400,000 or less. Preferably, the water-dispersible emulsion is a polyester emulsion. Preferably, the water-soluble polymer compound is polyethyleneoxide.

12 Claims, 6 Drawing Sheets

IMAGE-RECORDING MATERIAL, PROCESS FOR PRODUCING THE SAME AND PROCESS FOR FORMING IMAGE

This application claims priority to JP 2003-201997, filed Jul. 25, 2003.

BACKGROUND OF THE INVENTION

1. Field of the Invention

The present invention relates to an image-recording material properly adapted to electrophotographic materials, thermosensitive coloring materials, inkjet recording materials, sublimation transfer materials, silver halide photographic materials, thermal transfer materials, or the like; wherein a coating liquid for image-recording layer, that contains a water-dispersible emulsion and a water-soluble polymer compound, may prevent a flocculation, exhibit an enhanced stability, present an improved film-forming performance, and provide superior surface conditions. The present invention also relate to a process for producing the image-recording material and a process for forming an image that utilizes the image-recording material.

2. Description of the Related Art

Electrophotographic processes are broadly applied to various copiers, printers of personal computers and the like since the process allows dry processing, provides high-speed printing, and allows printing on general-purpose paper such as plain paper and wood-free paper. The toner-image-receiving layers of electrophotographic-image-receiving sheets utilized in the electrophotographic process are formed from various processes. For example, a process is proposed in which a thermoplastic resin is melted and extruded on a support such as raw paper to form a laminate, alternatively a process is proposed in which a resin solution or resin dispersion is coated on a support, and others are proposed.

Among these proposals, such process as coating a water-dispersible emulsion on a support has been widely investigated in recent years, since the process is less likely to cause environmental issues, and the cost of the materials is relatively low. In the process, in order to coat appropriately the water-dispersible emulsion on the support, the viscosity of the coating liquid for toner-image-receiving layer should be raised by adding a water-soluble polymer compound or the like. However, when a water-soluble polymer compound is added to a water-dispersible emulsion, the flocculation of the coating liquid of the toner-image-receiving layer is often induced, the coating liquid is likely to decrease the stability, and the coated film tends to exhibit poor surface conditions after drying, and also the coated film tends to be brittle, therefore such problems as defect and cracking of the film may be unavoidable, resulting in the diminish of the product value.

In the prior art, Japanese Patent Application Laid-Open JP-A) No. 05-214269 and Bunsan Gyoshu no kaimei to Ohyogijyutsu "Clarification of Dispersion and Flocculation and Applied Technology", Fumio Kitahara, by Techno System co. jp, 1992 describe the addition of water-soluble polymer compounds to water-dispersible emulsions in order to adjust the viscosities. However, these literatures do not disclose or suggest the average particle size of the water-dispersible emulsions, molecular weight of the water-soluble polymer compounds, or these optimizations, therefore the aforesaid objection have not been solved in the prior art.

Accordingly, an image-recording material has not been provided yet that may prevent a flocculation, exhibit an enhanced stability, present an improved film-forming performance, and provide superior surface conditions.

The object of the present invention is to provide an image-recording material properly adapted to electrophotographic materials, thermosensitive coloring materials, inkjet recording materials, sublimation transfer materials, silver halide photographic materials, thermal transfer materials, or the like; wherein a coating liquid for image-recording layer, that contains a water-dispersible emulsion and a water-soluble polymer compound, may prevent a flocculation, exhibit an enhanced stability, present an improved film-forming performance, and provide superior surface conditions. The object of the present invention is also to provide a process for producing the image-recording material and a process for forming an image that utilizes the image-recording material.

SUMMARY OF THE INVENTION

The image-recording material according to the present invention comprises a support, and at least one image-recording layer on the support, wherein the image-recording layer is formed from a water-dispersible emulsion of which volume-average particle size is 55 nm or more and a water-soluble polymer compound of which weight-average molecular weight (Mw) is 400,000 or less.

As a result, the coating liquid for image-recording layer may prevent a flocculation, exhibit an enhanced stability, present an improved film-forming performance, and provide superior surface condition, even though the coating liquid is comprised of the water-dispersible emulsion and the water-soluble polymer compound. Consequently, the image-recording material according to the present invention may be properly applied to electrophotographic materials, thermosensitive coloring materials, inkjet recording materials, sublimation transfer materials, silver halide photographic materials, and thermal transfer materials.

The process for producing the image-recording material according to the present invention comprises at least forming an image-recording layer. In forming the image-recording layer, the coating liquid for the image-recording layer that comprises the water-dispersible emulsion of which volume-average particle size is 55 nm or more and a water-soluble polymer compound of which weight-average molecular weight (Mw) is 400,000 or less is applied to the support to form the image-recording layer.

As a result, the flocculation of the coating liquid for image-recording layer may be prevented, the stability may be enhanced, the film-forming performance may be improved, and image-recording layers may be provided with superior surface conditions.

The process for forming an image according to the present invention comprises forming a toner image on the electrophotographic material, and smoothening and fixing the surface of the resulting toner image. According to the inventive process for forming an image, images may be efficiently produced by an easy processing, and the resulting images show high quality similar to those of the prints obtained by silver halide photography.

Figure 1:
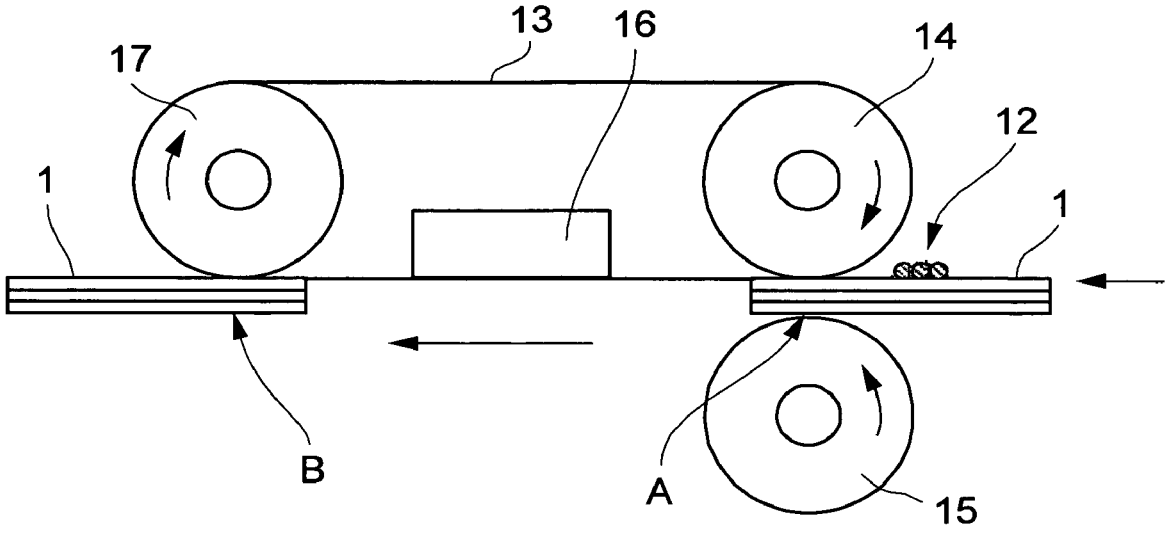
FIG. 1 schematically shows an exemplary belt fixing device available in the process for forming an image according to the present invention.

DESCRIPTION OF THE PREFERRED EMBODIMENTS (Image-recording Material)

The image-recording material according to the present invention comprises a support, at least one image-recording layer on the support, and the other layers properly selected depending on the necessities such as a backing layer, surface protection layer, intermediate layer, undercoat layer, cushion layer, static control or prevention layer, reflecting layer, color-tone-adjusting layer, storage property improving layer, antistick layer, anticurl layer, smoothing layer and the like. These layers may have a single layer structure or laminated structure.

Image-recording Layer

The image-recording layer indicates at least one layer formed on the support for recording images. In the silver-halide-photography materials, the image-recording layer corresponds to the photographic emulsion layer that develops YMC colors; in the inkjet recording materials, it corresponds to the ink image receiving layer that receives and sustains the ink; in the electrophotography materials, it corresponds toner-image-receiving layer; and in the thermosensitive materials, it corresponds to the thermosensitive-image-recording layer.

The image-recording layer comprises a water-dispersible emulsion and a water-soluble polymer compound, and the other ingredients depending on the requirements.

The volume-average particle size of the water-dispersible emulsion is required to be 55 nm (nano meter) or more, preferably 55 to 180 nm. When the volume-average particle size of the water-dispersible emulsion is less than 55 nm, the coating liquid for image-recording layer is likely to yield flocculation, and the film-forming performance may be deteriorated.

The volume-average particle size may be determined, for example, by means of Microtrac Particle Size Analyzer (UPA150 MODEL No. 9340, by Nikkiso Co., Ltd.), following to dilute the water-dispersible polyester emulsion with de-ionized water to the concentration of about 0.1% by mass as solid content.

The weight-average molecular weight (Mw) of the water-soluble polymer compound is 400,000 or less, is preferably 100,000 to 400,000. When the weight-average molecular weight (Mw) of the water-soluble polymer compound is over 400,000, the coating liquid for image-recording layer tends to coagulate, and the coated surface conditions may be of inferior quality.

In the coating liquid for image-recording layer, containing the water-dispersible emulsion and the water-soluble polymer compound, the adsorbed amount of the water-soluble polymer compound is preferably less than 2% by mass. When the adsorbed amount of the water-soluble polymer compound is over 2% by mass, flocculation may yield in the coating liquid for image-recording layer that contains the water-dispersible emulsion and the water-soluble polymer compound.

By the way, the adsorbed amount of the water-soluble polymer compound may be determined by at first blending the water-dispersible polyester emulsion and the water-soluble polymer compound (mass ratio being 100/17 in terms of water-dispersible polyester emulsion/water-soluble polymer compound), the amount of water-soluble polymer compound (polyethylene oxide) dissolved in the supernatant after centrifugation is analyzed quantitatively by means of NMR, then the adsorbed amount (% by mass) of polyethyleneoxide is determined based on the added amount of polyethyleneoxide.

In addition, 2 to 5% by mass of the adsorbed amount suggests the occurrence of depletion flocculation, and 30% or more by mass of the adsorbed amount suggests the occurrence of adsorption flocculation.

The water-dispersible emulsion may be properly selected depending on the application, provided that the volume-averaged particle size is 55 nm (nano meter) or more; examples of the water-dispersible emulsion include water-dispersible polyurethane emulsions, water-dispersible polyester emulsions, chloroprene emulsions, styrene-butadiene emulsions, nitrile-butadiene emulsions, butadiene emulsions, vinylchloride emulsions, vinylpyridine-styrene-butadiene emulsions, polybutene emulsions, polyethylene emulsions, vinylacetate emulsions, ethylene-vinylacetate emulsions, vinylidenechloride emulsions, methylmethacrylate-butadiene emulsions, and the like. Among these, water-dispersible polyester emulsions are particularly preferred.

The content of the water-dispersible emulsion in the image-recording layer is preferably 10 to 90% by mass, and more preferably 10 to 70% by mass.

The water-soluble polymer compound may be properly selected depending on the application without particular limitations, provided that the weight-averaged molecular weight (Mw) is 400,000 or less. Examples of the water-soluble polymer compound include polyvinyl alcohol, carboxy-modified polyvinyl alcohol, carboxymethylcellulose, hydroxyethylcellulose, cellulose sulfate, polyethylene oxides, gelatin, cationic starch, casein, sodium polyacrylate, styrene-maleic anhydride copolymer sodium salt, sodium polystyrene sulfonate, and the like. Among these, polyethylene oxide is preferable in particular.

The content of the water-soluble polymer compound in the image-recording layer is preferably 0.5 to 2 $g/m^2$.

The mass ratio of the water-dispersible emulsion to the water-soluble polymer compound (water-dispersible emulsion: water-soluble polymer compound) is preferably 1:0.01 to 1:1, more preferably 1:0.1 to 1:1. When the content of the water-soluble polymer compound is excessively low, the water-dispersible emulsion may separate after being coated and dried on the support; on the other hand, when the content is excessively high, the fusion of the particles in the water-dispersible emulsion or film-forming performance may be inhibited at the stage of drying after coating.

The image-recording layer may be applied to various image-recording materials selected from electrophotographic materials, thermosensitive coloring materials, inkjet recording materials, sublimation transfer materials, silver halide photographic materials, and thermal transfer materials. The image-recording layer is preferably applied to the electrophotographic materials in particular among these materials. The image-recording layer may suitably contain the other ingredients depending on the image-recording material and also individual requirement as explained later.

The coated amount of the image-recording layer is preferably 1 to 20 g/m$^2$ as the mass measured after coating and drying, more preferably 4 to 15 g/m$^2$. The thickness of the image-recording layer may be properly selected depending on the application, preferably is 1 to 30 μm, more preferably is 2 to 20 μm.

(Process for Producing Image-Recording Material)

The process for producing the inventive image-recording material comprises at least forming the image-recording layer and the others depending on the requirements. In accordance with the present invention, the coating liquid for image-recording layer may prevent the flocculation, may exhibit enhanced stability, may improve the film-forming performance, and the image-recording layer may be provided with superior surface conditions.

In forming the image-recording layer, a coating liquid, which comprises the water-dispersible emulsion of which volume-average particle size is 55 nm or more and the water-soluble polymer compound of which weight-average molecular weight (Mw) is 400,000 or less, is coated on a support, then the image-recording layer is formed.

The mass ratio of the water-dispersible emulsion to the water-soluble polymer compound (water-dispersible emulsion: water-soluble polymer compound) in the coating liquid for image-recording layer is preferably 1:0.01 to 1:1, more preferably 1:0.1 to 1:1. The aforesaid others include drying, forming the other layer, and the like.

Support

The support may be properly selected without particular limitations; examples of the support include raw paper, synthetic paper, synthetic resin sheet, coated paper, laminated paper, and the like. The support may be of single layer or laminated layers. Among these, the laminated paper coated with polyolefin resin layers on both sides of the raw paper is preferred with respect to smoothness, gloss and elastic properties.

Raw Paper

The raw paper may be a high quality paper, for example, the paper described in Shashin kogaku no kiso—ginen shashin hen "Basic Photography Engineering—Silver Halide Photography", CORONA PUBLISHING CO., LTD. (1979) pp. 223-224, edited by the Institute of Photography of Japan.

The raw paper may be properly selected without particular limitations, provided that it is common or conventional material for support. Examples of the raw paper material include natural pulp of needle-leaf tree or broad-leaf tree, mixture of natural pulp and synthetic pulp and the like.

As for the pulp available for the raw paper, broadleaf tree bleached kraft pulp (LBKP) is preferred from the viewpoint of good balance between surface flatness and smoothness of the raw paper, rigidity and dimensional stability or curling resistance. Needle-leaf bleached kraft pulp (NBKP), broadleaf tree sulfite pulp (LBSP) and the like may also be available.

A beater or refiner and the like may be employed for beating the pulp.

The Canadian Standard Freeness of the pulp is preferably 200 to 440 ml CSF, and more preferably 250 to 380 ml CSF, to control contraction of paper during the treatment.

Various additives, for example, filler, dry paper reinforcer, sizing agent, wet paper reinforcer, fixing agent, pH regulator or other agents and the like may be added, if necessary, to the pulp slurry (hereinafter, referring to "pulp paper material") which is obtained after beating the pulp.

Examples of the filler include calcium carbonate, clay, kaolin, white clay, talc, titanium oxide, diatomaceous earth, barium sulfate, aluminum hydroxide, magnesium hydroxide and the like.

Examples of the dry paper reinforcer include cationic starch, cationic polyacrylamide, anionic polyacrylamide, amphoteric polyacrylamide, carboxy-modified polyvinyl alcohol and the like.

Examples of the sizing agent include aliphatic salts, rosin, derivatives of rosin such as maleic rosin and the like, paraffin wax, alkyl ketene dimer, alkenyl succinic anhydride (ASA), epoxy aliphatic amide, and the like.

Examples of the wet paper reinforcer include polyamine polyamide epichlorohydrin, melamine resins, urea resins, epoxy polyamide resins, and the like.

Examples of the fixing agent include polyfunctional metal salts such as aluminum sulfate, aluminum chloride, and the like; cationic polymers such as cationic starch, and the like.

Examples of the pH regulator include caustic soda, sodium carbonate, and the like.

Examples of other agents include defoaming agents, dyes, slime control agents, fluorescent whitening agents, and the like.

In addition, softeners may also be added if necessary. For the softeners, ones which are disclosed on pp. 554-555 of *Paper and Paper Treatment Manual* (Shiyaku Time Co., Ltd.) (1980) and the like may be employed, for example.

These various additives may be used alone or in combination. The loadings of these additives to the pulp paper material may be properly selected; usually the loadings are preferably 0.1 to 1.0% by mass.

The pulp slurry or pulp paper material, to which these various additives are compounded depending on the requirements, was formed into paper by means of paper machine such as hand paper machine, Fortlinear paper machine, round mesh paper machine, twin wire machine, combination machine, and the like, followed by drying to prepare raw paper. In addition, sizing treatment on the surface may be provided at prior to or following the drying if necessary.

The treatment liquid used for sizing the surface may be properly selected without particular limitations. The treatment liquid may be compounded with such material as water-soluble polymers, waterproof materials, pigments, dyes, fluorescent whitening agents, and the like.

Examples of the water-soluble polymer include cationic starch, polyvinyl alcohol, carboxy-modified polyvinyl alcohol, carboxymethyl cellulose, hydroxyethyl cellulose, cellulose sulfate, gelatin, casein, sodium polyacrylate, styrene-maleic anhydride copolymer sodium salt, sodium polystyrene sulfonate, and the like.

Examples of the waterproof material include latex emulsions such as styrene-butadiene copolymer, ethylene-vinyl acetate copolymer, polyethylene, vinylidene chloride copolymer and the like; polyamide polyamine epichlorohydrin and the like.

Examples of the pigment include calcium carbonate, clay, kaolin, talc, barium sulfate, titanium oxide, and the like.

As for the raw paper, in order to improve the rigidity and dimensional stability or curling resistance, it is preferred that the ratio (Ea/Eb) of the longitudinal Young's modulus (Ea) and the lateral Young's modulus (Eb) is within the range of 1.5 to 2.0. When the ratio (Ea/Eb) is less than 1.5 or more than 2.0, the rigidity and curling properties of the image-recording material is likely to be inferior, and may cause some problem on the conveying operation.

It has been found that, in general, the "stiffness" of the paper differs depending on the various manners in which the paper is beaten, and the elasticity or modulus of paper produced by paper making process through beating operation may employ "stiffness" of the paper as an important indication. The elastic modulus of the paper may be calculated from the following equation by using the relation of the density and the dynamic modulus that shows the physical properties of a viscoelastic object, and by measuring the velocity of sound propagation in the paper using an ultrasonic oscillator.

$$E=\rho c^2(1-n^2)$$

wherein "E" represents dynamic modulus; "ρ" represents density; "c" represents the velocity of sound in paper; and "n" represents Poisson's ratio.

Since n=0.2 or so in a case of ordinary paper, there is not much difference in the calculation, even if the calculation is performed by the following equation:

$$E=\rho c^2$$

Accordingly, if the density of the paper and acoustic velocity are measured, the elastic modulus may be easily calculated. In the above equation, when measuring acoustic velocity, various instruments known in the art may be available, such as Sonic Tester SST-110 (Nomura Shoji Co., Ltd.) and the like.

In the raw paper, it is preferred to employ pulp fibers having a fiber length distribution as disclosed, for example, in JP-A No. 58-68037 (e.g., the sum of 24 mesh on and 42 mesh on is 20 to 45% by mass, and 24 mesh on is 5% or less by mass) in order to give the desired center line average roughness to the surface. Moreover, the center line average roughness may be adjusted by heating and giving a pressure to a surface of the raw paper, with a machine calender, super calender and the like.

The thickness of the raw paper may be properly selected depending on the application, usually 30 to 500 μm is preferred, 50 to 300 μm is more preferred, and 100 to 250 μm is still more preferred. The basis weight of the raw paper may be properly selected depending on the application, for example, 50 to 250 g/m$^2$ is preferred, and 100 to 200 g/m$^2$ is more preferred.

Synthetic Paper

Synthetic paper is a kind of paper of which the main component is polymer fibers other than cellulose. Examples of the polymer fibers include polyolefin fibers such as polyethylene, polypropylene, and the like.

Synthetic Resin Sheet (Film)

The synthetic resin sheet may be synthetic resin formed in the shape of sheet or film. Examples thereof include polypropylene film, stretched polyethylene film, stretched polypropylene, polyester film, stretched polyester film, nylon film, and the like. Further, films made white by stretching, white films containing white pigment, and the like may be available.

Coated Paper

The coated paper is one produced by coating various resins on at least one surface of substrate such as raw paper, and the coated amount differs depending on the application. Examples of the coated paper include art paper, cast coated paper, Yankee paper, and the like.

The resin coated on the surface of the raw paper may be properly selected without particular limitations, preferably is thermoplastic resin. Examples of the thermoplastic resin include (1) polyolefin resins, (2) polystyrene resins, (3) acryl resins, (4) polyvinyl acetate and derivatives thereof, (5) polyamide resins, (6) polyester resins, (7) polycarbonate resins, (8) polyether (polyacetal) resins, and (9) the other resins. These thermoplastic resins may be used alone or in combination.

The aforesaid (1) polyolefin resins include, for example, olefin resins such as polyethylene and polypropylene, and copolymers of olefin monomers such as ethylene or propylene and the other vinyl monomers. Examples of the copolymer resin of olefin monomer and the other vinyl monomer include ethylene-vinylacetate copolymer, ionomer resin which is copolymer of olefin monomer and acryl acid or methacrylic acid and the like. Further, the derivatives of polyolefin resin include chlorinated polyethylene, chlorosulfonated polyethylene and the like.

The aforesaid (2) polystyrene resins include, for example, polystyrene resin, styrene-isobutylene copolymer, acrylonitrile-styrene copolymer (AS resin), acrylonitrile-butadiene-styrene copolymer (ABS resin), polystyrene-maleicanhydride resin, and the like.

The aforesaid (3) acryl resins include, for example, polyacrylic acid, polyacrylate, polymethacrylic acid, polymethacrylate, polyacrylonitrile, polyacrylamide, and the like.

The esters of polyacrylic acid or polymethacrylic acid exhibit significantly various properties depending on the ester groups. Further, the (3) acryl resins include the copolymers with other monomers (e.g., acrylic acid, methacrylic acid, styrene, vinyl acetate etc.). The polyacrylonitrile is often utilized in copolymers as AS resin or ABS resin rather than a sole polymer.

The aforesaid (4) polyvinyl acetate and derivatives thereof include, for example, polyvinyl acetate, polyvinyl alcohol formed by partially saponify polyvinyl acetate, polyvinyl acetal resins formed by reacting polyvinyl alcohol with aldehyde (e.g., formaldehyde, acetaldehyde, butylaldehyde etc.).

The aforesaid (5) polyamide resins include polycondensation products of diamine and dibasic acid, for example, 6-nylon and 6,6-nylon.

The aforesaid (6) polyester resins include polycondensation products of alcohol and acid, and exhibits a wide variety of properties depending on the combination of the alcohol and acid. Conventional polyethylene terephthalate and polybutylene terephthalate formed from aromatic dibasic acid and divalent alcohol may be exemplified.

The aforesaid (7) polycarbonate resins typically include polycarbonate obtained from bisphenol A and phosgene.

The aforesaid (8) polyether (polyacetal) resins include, for example, polyether resins such as polyethylene oxide and polypropyleneoxide, and polyacetal resins such as polyoxymethylene obtained through ring-opening-polymerization.

The aforesaid (9) the other resins include polyurethane resins obtained through additional-polymerization and the like.

In addition, the thermoplastic resins may be incorporated with pigments or dyes such as brightener, conductive agent, filler, titanium oxide, ultramarine, carbon black, and the like depending on the application.

Laminated Paper

The laminated paper is one which is formed by laminating materials selected from various resins, rubbers, polymer sheets or films on substrate such as raw paper. Examples of the laminating material include polyolefin resins, polyvinyl chloride resins, polyester resins, polystyrene resins, polymethacrylate resins, polycarbonate resins, polyimide resins, triacetyl cellulose, and the like. These resins may be used alone or in combination.

The aforesaid polyolefin is often low-density polyethylene (LDPE); when the heat resistance should be enhanced, preferably, polypropylene, blend of polypropylene and polyethylene, high-density polyethylene (HDPE), blend of high-density polyethylene and low-density polyethylene and the like is utilized. From the viewpoint of cost and laminate applicability in particular, the blend of high-density polyethylene and low-density polyethylene is most preferable.

The blending ratio by mass of the high-density polyethylene and low-density polyethylene is preferably from 1:9 to 9:1, more preferably 2:8 to 8:2, and most preferably from 3:7 to 7:3. When thermoplastic resin layers are formed on both sides of the raw paper, preferably, the back side of the raw paper is formed of high-density polyethylene or a blend of high-density polyethylene and low-density polyethylene. The molecular weight of the polyethylene is not particularly limited, but it is preferable that melt indices of both high-density polyethylene and low-density polyethylene are 1.0 to 40 g/10-minute and that the polyethylene exhibits a suitable extrusion property.

Further, these sheets or films may be applied a treatment so as to take a reflectivity against white color. Examples of such treatment include compounding a pigment such as titanium oxide or the like into the sheets or films.

The thickness of the support is preferably 25 to 300 μm, more preferably 50 to 260 μm, and still more preferably 75 to 220 μm. The rigidity of the support may vary depending on the application; preferably, the rigidity of the support utilized for the electrophotographic-image-receiving sheet of photographic image quality is similar to that of the support utilized for color silver halide photography.

The image-recording material according to the present invention comprises a support and at least one image-recording layer on the support. The image-recording material may be various electrophotographic material, thermosensitive coloring material, inkjet recording material, sublimation transfer material, silver halide photographic material, and thermal transfer material, for example, depending on the application or field.

<Electrophotographic Material>

The electrophotographic material comprises a support, and at least one layer of toner-image-receiving layer as the inventive image-recording material on at least one surface of the support; and also comprises the other layers properly selected depending on the necessities such as a backing layer, surface protection layer, intermediate layer, undercoat layer, cushion layer, static control or prevention layer, reflecting layer, color tone adjusting layer, storage property improving layer, antistick layer, anticurl layer, smoothing layer and the like. These layers may have a single layer structure or laminated structure.

The aforesaid toner-image-receiving layer receives color and/or black toners and forms images. Specifically, the toner-image-receiving layer performs to receive a toner for forming images by means of a developing drum or an intermediate transferring body through static electricity and/or pressure in a transferring operation, and to fix images through heat and/or pressure in a fixing operation.

The toner-image-receiving layer may be incorporated various additives in order to improve the thermodynamic properties other than the water-dispersible emulsion and water-soluble polymer compound explained with respect to the image-recording layer. Examples of such additives include releasing agent, plasticizer, coloring agent, filler, cross-linker, antistat, emulsifier, dispersant and the like.

Releasing Agent

The releasing agent is compounded into the toner-image-receiving layer in order to prevent offset of the toner-image-receiving layer. The releasing agent available in the present invention may be properly selected from any kind of agents provided that it melts by heating to the fixing temperature, it precipitates at the surface of the toner-image-receiving layer and exists exclusively at the surface after being cooling, and also it forms a releasing agent layer on the surface of the toner-image-receiving layer after being cooled and solidified.

Examples of the releasing agent include silicone compounds, fluorine compounds, waxes, and matting agents.

The releasing agent may, for example, be a compound mentioned in "Properties and Applications of Wax (Revised)" by Saiwai Publishing, or in the Silicone Handbook published by THE NIKKAN KOGYO SHIMBUN. Also, the silicone compounds, fluorine compounds and waxes in the toners mentioned in Japanese Patent Application Publication (JP-B) No. 59-38581, JP-B No.04-32380; Japanese Patent (JP-B) No.2838498, and JP-B No.2949558; and Japanese Patent Application Laid-Open (JP-A) No.50-117433, JP-A No. 52-52640, No. 57-148755, No.61-62056, No.61-62057, No.61-118760, No.0242451, No.03-41465, No.04-212175, No.04-214570, No.04-263267, No.05-34966, No.05-119514, No.06-59502, No.06-161150, No.06-175396, No.06-219040, No.06-230600, No.06-295093, No.07-36210, No.07-43940, No. 07-56387, No. 07-56390, No. 07-64335, No. 07-199681, No. 07-223362, No.07-287413, No.08-184992, No.08-227180, No.08-248671, No.08-248799, No.08-248801, No.08-278663, No.09-152739, No.09-160278, No.09-185181, No.09-319139, No.09-319143, No.10-20549, No.1048889, No.10-198069, No.10-207116, No.11-2917, No.11-44969, No.11-65156, No.11-73049 and No.11-194542 may be used. These compounds may be used alone or in combination.

Examples of the silicone compound include silicone oils, silicone rubbers, silicone fine particles, silicone-modified resins, and reactive silicone compounds.

Examples of the silicone oil include non-modified silicone oils, amino-modified silicone oils, carboxy-modified silicone oils, carbinol-modified silicone oils, vinyl-modified silicone oils, epoxy-modified silicone oils, polyether-modified silicone oils, silanol-modified silicone oils, methacryl-modified silicone oils, mercapto-modified silicone oils, alcohol-modified silicone oils, alkyl-modified silicone oils, and fluorine-modified silicone oils.

Examples of the silicone-modified resin include olefin resins, polyester resins, vinyl resins, polyamide resins, cellulosic resins, phenoxy resins, vinyl chloride-vinyl acetate resins, urethane resins, acrylic resins, styrene-acrylic resins, compounds in which copolymerization resins thereof are modified by silicone.

The fluorine compound may be properly selected depending on the application; examples of the fluorine compound include fluorine oils, fluororubbers, fluorine-modified resins, fluorine sulfonic acid compounds, fluorosulfonic acids, and fluorine acid compounds or salts, and inorganic fluorides.

The aforesaid waxes are generally classified into natural waxes and synthetic waxes. The natural waxes are preferably selected from vegetable waxes, animal waxes, mineral waxes, and petroleum waxes. Among these, vegetable waxes are preferable in particular. Further, water-dispersible waxes are preferable among the natural waxes due to the compatibility when an aqueous resin is employed as the polymer of the toner-image-receiving layer.

The vegetable wax may be properly selected from conventional or known waxes, and may be available from commercial products or may be properly produced. Examples of the vegetable wax include carnuba waxes, castor oil, rapeseed oil, soybean oil, Japan tallow, cotton wax, rice wax, sugarcane wax, candelilla wax, Japan wax, jojoba oil, and the like.

Examples of the commercial carnauba wax include EMUSTAR AR-0413 from Nippon Seiro Co., Ltd., and Cellusol 524 from Chukyo Yushi Co., Ltd. and the like. Example of commercial castor oil is the purified castor oil from Itoh Oil Chemicals Co., Ltd. Among these, a carnauba wax having a melting point of 70° C. to 95° C. is particularly preferable from viewpoints of providing an electrophotographic-image-receiving sheet which is excellent in anti-offset properties, adhesive resistance, paper transporting properties, gloss, is less likely to cause crack and splitting, and is capable of forming a high quality image.

The animal wax may be properly selected from conventional or known waxes; examples of the animal wax include beeswax, lanolin, spermaceti, whale oil, wool wax, and the like.

The mineral wax may be properly selected from conventional or known waxes, and may be available from commercial products or may be properly produced. Examples of the mineral wax include montan wax, montan ester wax, ozokerite, ceresin, and the like. Among these, montan wax having a melting point of 70° C. to 95° C. is particularly preferable from viewpoints of providing an electrophotographic-image-receiving sheet which is excellent in anti-offset properties, adhesive resistance, paper transporting properties, gloss, is less likely to cause crack and splitting, and is capable of forming a high quality image.

The petroleum wax may be properly selected from conventional or known waxes, and may be available from commercial products or may be properly produced. Examples of the petroleum wax include paraffin wax, microcrystalline wax, petrolatum, and the like.

The content of the natural wax in the toner-image-receiving layer is preferably 0.1 to 4 g/m$^2$, and more preferably 0.2 to 2 g/m$^2$.

When the content is less than 0.1 g/m$^2$, the anti-offset properties and the adhesive resistance may be deteriorated; when the content is more than 4 g/m$^2$, the image quality may be deteriorated due to the excessive amount of wax.

The melting point of the natural wax is preferably 70 to 95° C., and more preferably is 75 to 90° C., from the viewpoint of anti-offset and paper conveying properties.

The synthetic waxes may be classified into synthetic hydrocarbons, modified waxes, hydrogenated waxes, and the other waxes of fats and fatty oils. These waxes are preferably water-dispersible waxes considering the compatibility when an aqueous thermoplastic resin is employed as the thermoplastic resin in the toner-image-receiving layer.

Examples of aforesaid synthetic hydrocarbon include Fischer toropush wax, polyethylene wax.

Examples of the synthetic wax of fat and fatty oil include acid amide compounds such as stearic acid amide, and acid imide compounds such as anhydrous phthalic acid imide.

The modified wax may be properly selected depending on the application; examples of the modified wax include amine-modified polypropylene, acrylic acid-modified wax, fluorine-modified wax, olefin-modified wax, urethane wax, alcohol wax, and the like.

The hydrogenated wax may be properly selected depending on the application; examples of the hydrogenated wax include cured castor oil, castor oil derivatives, stearic acid, lauric acid, myristic acid, palmitic acid, behenic acid, sebacic acid, undecylenic acid, heptyl acids, maleic acid, high grade maleic oils, and the like.

The matting agent may be selected from known or conventional matting agents. Solid particles for use in the matting agents may be classified into inorganic particles and organic particles.

Specifically, the inorganic matting agents may be oxides such as silicon dioxide, titanium oxide, magnesium oxide, and aluminum oxide; alkaline earth metal salts such as barium sulfate, calcium carbonate, and magnesium sulfate; silver halides such as silver chloride, and silver bromide; glass, and the like.

Examples of the inorganic matting agent may be found, for example, in West German Patent No. 2529321, U.K. Patent No. 760775, No. 1260772, and U.S. Pat. No. 1,201,905, No. 2192241, No. 3053662, No. 3062649, No. 3257206, No. 3322555, No. 3353958, No. 3370951, No. 3411907, No. 3437484, No. 3523022, No. 3615554, No. 3635714, No. 3769020, No. 4021245 and No. 4029504.

Materials of the organic matting agent include starch, cellulose ester (e.g., cellulose acetate propionate), cellulose ether (e.g., ethyl cellulose) and synthetic resin. The synthetic resin is preferred to be insoluble or difficult to be solved. Examples of the synthetic resin insoluble or difficult to be solved, include polymethacrylicacid esters such as polyalkyl methacrylate, polyalkoxyalkyl methacrylate, polyglycidyl methacrylate, and polymeth acrylamide; polyvinyl esters such as polyvinyl acetate; polyacrylonitrile, polyolefins such as polyethylene; polystyrene, benzoguanamine resin, formaldehyde condensation polymer, epoxy resin, polyamide, polycarbonate, phenolic resin, polyvinyl carbazole, polyvinylidene chloride, and the like. Copolymers, which are combined the monomers contained in the above polymers, may also be used.

In the case of the copolymers, a small amount of hydrophilic-repeating units may be included. Examples of monomer which forms a hydrophilic-repeating unit include acrylic acid, methacrylic acid, $\alpha,\beta$-unsaturated dicarboxylic acid, hydroxyalkyl methacrylate, sulfoalkyl methacrylate, styrene sulfonic acid, and the like.

Examples of the organic matting agents can be found, for example, in the U.K. Patent No. 1055713, the U.S. Pat. No. 1,939,213, No. 2,221,873, No. 2,268,662, No. 2,322,037, No. 2,376,005, No. 2,391,181, No. 2,701,245, No. 2,992,101, No. 3,079,257, No. 3,262,782, No. 3,443,946, No. 3,516,832, No. 3,539,344, No. 3,591,379, No. 3,754,924 and No. 3,767,448, and JP-A No. 49-106821, and No. 57-14835.

Also, two or more types of solid particles may be employed in conjunction as a matting agent. The average particle size of the solid particles of the matting agent may suitably be, for example, 1 to 100 μm, and is more preferably 4 to 30 μm. The usage amount of the matting agent may suitably be 0.01 to 0.5 g/m$^2$, more preferably is 0.02 to 0.3 g/m$^2$.

The melting point (° C.) of the releasing agent is preferably 70 to 95° C., and more preferably 75 to 90° C., from the viewpoints of anti-offset properties and paper conveying properties.

The releasing agents for use in the toner-image-receiving layer may alternatively be derivatives, oxides, purified products, and mixtures of the aforementioned substances. These may also have reactive substituentes.

The content of the releasing agent in the toner-image-receiving layer is preferably 0.1 to 10% by mass, more preferably 0.3 to 8.0% by mass, still more preferably 0.5 to 5.0% by mass. When the content is less than 0.1% by mass, the offset resistance and the adhesion resistance may be insufficient, when over 10% by mass, the resulting image quality may be poor due to the excessive amount of the releasing agent.

Plasticizer

The plasticizers known in the art may be used without particular limitation. These plasticizers have the effect of adjusting the fluidity or softening of the toner-image-receiving layer in connection with heat and/or pressure at fixing the toner.

The plasticizer may be selected by referring to "Chemical Handbook," (Chemical Institute of Japan, Maruzen), "Plasticizers—their Theory and Application," (ed. Koichi Murai, Saiwai Shobo), "The Study of Plasticizers, Part 1" and "The Study of Plasticizers, Part 2" (Polymer Chemistry Association), or "Handbook of Rubber and Plastics Blending Agents" (ed. Rubber Digest Co.), or the like.

Examples of the plasticizer include phthalic esters, phosphate esters, aliphatic acid esters, abiethyne acid ester, abietic acid ester, sebacic acid esters, azelinic ester, benzoates, butylates, epoxy aliphatic acid esters, glycolic acid esters, propionic acid esters, trimellitic acid esters, citrates, sulfonates, carboxylates, succinic acid esters, maleates, fumaric acid esters, phthalic acid esters, stearic acid esters, and the like; amides (e.g., aliphatic acid amides and sulfoamides); ethers; alcohols; lactones; polyethyleneoxy; and the like (see, for example, JP-A No. 59-83154, No. 59-178451, No. 59-178453, No. 59-178454, No. 59-178455, No. 59-178457, No. 62-174754, No. 62-245253, No. 61-209444, No. 61-200538, No. 62-8145, No. 62-9348, No. 62-30247, No. 62-136646, and No. 02-235694, and the like). The plasticizers may be utilized mixing into a resin.

The plasticizers may be polymers having relatively low molecular weight. In this case, it is preferred that the molecular weight of the plasticizer is lower than the molecular weight of the binder resin to be plasticized. Preferably, plasticizers have a molecular weight of 15000 or less, or more preferably 5000 or less. When a polymer plasticizer is used as the plasticizer, the polymer plasticizer is substantially the same kind with the binder resin to be plasticized. For example, when the polyester resin is plasticized, polyester having a lower molecular weight is preferable as the plasticizer. Further, oligomers may also be used as plasticizers.

Apart from the compounds mentioned above, there are commercially products such as, for example, Adecasizer PN-170 and PN-1430 from Asahi Denka Co., Ltd.; PARAPLEX-G-25, G-30 and G-40 from C. P. Hall; and, rosin ester 8 L-JA, ester R-95, pentalin 4851, FK 115, 4820, 830, Ruizol 28-JA, Picolastic A75, Picotex LC and Cristalex 3085 from Rika Hercules, Inc, and the like.

The plasticizer may be optionally employed to relax some stress and distortion, e.g. physical distortions of elasticity and viscosity, and distortions of mass balance in molecules, binder main chains or pendant portions, which are induced when toners are embedded in the toner-image-receiving layer.

The plasticizer may be dispersed microscopically in the toner-image-receiving layer. The plasticizer may also be dispersed microscopically in a sea-island state, in the toner-image-receiving layer. The plasticizer may present in the toner-image-receiving layer in a state of sufficiently mixed with the other components such as binder or the like.

The content of plasticizer in the toner-image-receiving layer is preferably 0.001 to 90% by mass, more preferably 0.1 to 60% by mass, and still more preferably 1 to 40% by mass.

The plasticizer may be employed for the purpose of adjusting the slidability i.e. the improvement of transportability by reducing friction, improving the offset of fixing part i.e. the release of toner or layer from the fixing part, adjusting the curling balance, adjusting the electrification i.e. the formation of a toner electrostatic image, and the like.

Colorant

The colorant may be properly selected depending on the application; examples of colorant include fluorescent whitening agents, white pigments, colored pigments, dyes, and the like.

The fluorescent whitening agent has absorption in the near-ultraviolet region, and is a compound that emits fluorescence in the range of 400 to 500 nm. The various fluorescent whitening agent known in the art may be used without particular limitations. Examples of the fluorescent whitening agent include the compounds described in "The Chemistry of Synthetic Dyes" Volume V, Chapter 8 edited by K. VeenRataraman. Specific examples of the fluorescent whitening agent include stilbene compounds, coumarin compounds, biphenyl compounds, benzo-oxazoline compounds, naphthalimide compounds, pyrazoline compounds, carbostyryl compounds, and the like. Examples of the commercial fluorescent whitening agents include WHITEX PSN, PHR, HCS, PCS, and B from Sumitomo Chemicals, UVITEX-OB from Ciba-Geigy, Co., Ltd., and the like.

The white pigment may be properly selected from conventional pigments depending on the application without particular limitations, examples of the white pigment include the inorganic pigments such as titanium oxide, calcium carbonate, and the like.

The colored pigment may be properly selected from conventional pigments depending on the application without particular limitations, examples of the colored pigment include various pigments described in JP-A No. 6344653, azo pigments, polycyclic pigment, condensed polycyclic pigment, lake pigment, carbon black and the like.

The azo pigments include azo lakes (e.g., carmine 6B, red 2B etc.), insoluble azo pigments (e.g., monoazo yellow, disazo yellow, pyrazolo orange, and Balkan orange etc.), and condensed azo pigments (e.g., chromophthal yellow, chromophthal red etc.).

The polycyclic pigments include phthalocyanines such as copper phthalocyanine blue and copper phthalocyanine green.

The condensed polycyclic pigments include dioxazine pigments such as dioxazine violet, isoindolinone pigments such as isoindolinone yellow, surene pigments, perylene pigments, perinon pigments, thioindigo pigments.

The lake pigments include malachite green, rhodamine B, rhodamine G, Victoria blue B and the like.

The inorganic pigments include oxides such as titanium dioxide and red iron oxide, sulfate such as precipitated barium sulfate, carbonate such as precipitated calcium carbonate, silicate such as hydrous silicate and anhydrous silicate, metal powder such as aluminum powder, bronze powder, zinc powder, chrome yellow, and iron blue.

These may be used alone or in combination.

The dyes may be properly selected from conventional dyes depending on the application without particular limitations; the dyes include anthraquinone compounds, azo compounds, and the like. These may be used alone or in combination.

As for the dyes of water-insoluble type, vat dyes, disperse dyes, oil-soluble dyes and the like are exemplified. The vat dyes include C.I. Vat violet 1, C.I. Vat violet 2, C.I. Vat violet 9, C.I. Vat violet 13, C.I. Vat violet 21, C.I. Vat blue 1, C.I. Vat blue 3, C.I. Vat blue 4, C.I. Vat blue 6, C.I. Vat blue 14, C.I. Vat blue 20 and C.I. Vat blue 35, and the like. The disperse dyes include C.I. disperse violet 1, C.I. disperse violet 4, C.I. disperse violet 10, C.I. disperse blue 3, C.I. disperse blue 7, C.I. disperse blue 58 and the like. The oil-soluble dyes include C. I. solvent violet 13, C.I. solvent violet 14, C.I. solvent violet 21, C.I. solvent violet 27, C.I. solvent blue 11, C.I. solvent blue 12, C.I. solvent blue 25, C.I. solvent blue 55, and the like.

Colored couplers used in silver halide photography may also be preferably used.

The content of the colorant in the toner-image-receiving layer is preferably 0.1 to 8 $g/m^2$, and more preferably is 0.5 to 5 $g/m^2$.

When the content of colorant is less than 0.1 $g/m^2$, the light transmittance in the toner-image-receiving layer becomes high, when it is more than 8 $g/m^2$, the handling becomes more difficult, due to crack and adhesive resistance.

The filler may be an organic or inorganic filler; and reinforcing materials for binder resins, bulking agents and reinforcements known in the art may be utilized.

The filler may be selected referring to "Handbook of Rubber and Plastics Additives" (ed. Rubber Digest Co.), "Plastics Blending Agents—Basics and Applications" (New Edition) (Taisei Co.), "The Filler Handbook" (Taisei Co.), and the like.

In addition, as for the filler, various inorganic fillers or pigments may be employed. Examples of inorganic filler or pigment include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, mullite, and the like. Among these, silica and alumina are particularly preferred. These fillers may be used alone or in combination. It is preferred that the filler is of relatively small particle size. If the particle size is relatively large, the surface of the toner-image-receiving layer is likely to be roughened.

The aforesaid silica includes spherical silica and amorphous silica. The silica may be synthesized by dry method, wet method or aerogel method. The surface of the hydrophobic silica particles may also be treated with trimethylsilyl groups or silicone. The silica is preferably colloidal silica, and the silica is preferably porous.

The aforesaid alumina includes anhydrous alumina and hydrated alumina. Examples of crystallized anhydrous alumina which may be available, are $\alpha$, $\beta$, $\gamma$, $\delta$, $\zeta$, $\eta$, $\theta$, $\kappa$, $\rho$, or $\chi$. Hydrated aluminas are preferred to anhydrous aluminas. The hydrated aluminas may be monohydrate or trihydrate. Monohydrate aluminas include pseudo-boehmite, boehmite and diaspore. Trihydrate aluminas include gibbsite and bayerite. The alumina is preferably porous alumina.

The alumina hydrate may be synthesized by a sol-gel method, in which ammonia is added to an aluminum salt solution to precipitate alumina, or by hydrolysis of an alkali aluminate. Anhydrous alumina may be obtained by dehydrating alumina hydrate by heating.

The loadings of the filler is preferably 5 to 2000 parts by mass based on 100 parts by mass of the dried binder in the toner-image-receiving layer.

A crosslinking agent may be added in order to adjust the storage stability or thermoplastic properties of the toner-image-receiving layer. Examples of the crosslinking agent include compounds containing two or more reactive groups in the molecule, such as an epoxy group, isocyanate group, aldehyde group, active halogen group, active methylene group, acetylene group and other reactive groups known in the art.

In addition, the cross-linking agent may also be a compound having two or more groups capable of forming bonds such as hydrogen bonds, ionic bonds, stereochemical bonds, and the like.

The cross-linking agent may be a compound known in the art such as a coupling agent for resin, curing agent, polymerizing agent, polymerization promoter, coagulant, film-forming agent, film-forming assistant, and the like. Examples of the coupling agent include chlorosilanes, vinylsilanes, epoxysilanes, aminosilanes, alkoxyaluminum chelates, titanate coupling agents, and the like. The examples further include other agents known in the art such as those mentioned in "Handbook of Rubber and Plastics Additives (ed. Rubber Digest Co.)."

Preferably, a charge control agent is incorporated into the toner-image-receiving layer in order to adjust transfer and adhesion of toner, and prevent charge adhesion of a toner-image-receiving layer.

The charge control agent may be any charge control agent known in the art. Examples of the charge control agent include surfactants such as a cationic surfactant, an anionic surfactant, an amphoteric surfactant, a nonionic surfactant, or the like; polymer electrolytes, electroconducting metal oxides, and the like.

Examples of the surfactant include cationic charge inhibitors such as quaternary ammonium salts, polyamine derivatives, cation-modified polymethylmethacrylate, cation-modified polystyrene, or the like; anionic charge inhibitors such as alkyl phosphates, anionic polymers, or the like; and nonionic charge inhibitors such as aliphatic ester, polyethylene oxide, or the like.

When the toner has a negative charge, the cationic charge control agent and the nonionic charge control agent, compounded in the toner-image-receiving layer, are preferably cationic or anionic.

Examples of aforesaid electroconducting metal oxide include ZnO, $TiO_2$, $SnO_2$, $Al_2O_3$, $In_2O_3$, $SiO_2$, MgO, BaO, $MoO_3$, and the like. These may be used alone or in combination.

Moreover, the metal oxide may contain other elements (doping). For example, ZnO may contain Al, In, or the like; $TiO_2$ may contain Nb, Ta, or the like; and $SnO_2$ may contain (or, dope) Sb, Nb, halogen elements, or the like.

Other Additives

Various additives may also be compounded into the toner-image-receiving layer in order to improve the output image stability or to improve stability of the toner-image-receiving layer itself. Examples of the additives include antioxidants, age resistors, degradation inhibitors, anti-ozone degradation inhibitors, ultraviolet ray absorbers, metal complexes, light stabilizers, preservatives, fungicide, and the like.

Examples of the antioxidant include chroman compounds, coumarane compounds, phenol compounds (e.g., hindered phenols), hydroquinone derivatives, hindered amine derivatives, spiroindan compounds, and the like. The antioxidants may be found, for example, in JP-A No. 61-159644.

Examples of age resistor include those found in Handbook of Rubber and Plastics Additives, Second Edition (1993, Rubber Digest Co.), pp. 76-121.

Examples of the ultraviolet ray absorbers include benzotriazo compounds (see U.S. Pat. No. 3,533,794), 4-thiazolidone compounds (see U.S. Pat. No. 3,352,681), benzophenone compounds (see JP-A No. 46-2784), ultraviolet-ray absorbing polymers (see JP-A No. 62-260152).

Examples of the metal complex include those described in U.S. Pat. No. 4,241,155, No. 4,245,018, No. 4,254,195; and JP-A No. 61-88256, No. 62-174741, No. 63-199248, No. 01-75568, No. 01-74272, and the like.

Further, ultraviolet ray absorbers and light stabilizers, those found in Handbook of Rubber and Plastics Additives, Second Edition (1993, Rubber Digest Co.), pp. 123-137 may be available.

Additives for photography known in the art may also be included in the available material to obtain the toner-image-receiving layer as described above. Examples of the photographic additive may be found in the Journal of Research Disclosure (hereinafter, referred to "RD") No. 17643 (December 1978), No. 18716 (November 1979) and No. 307105 (November 1989). The relevant sections are shown.

| Type of additive | RD17643 | RD18716 | RD307105 |
|---|---|---|---|
| 1. Whitener | p.24 | p.648 right column | p.868 |
| 2. Stabilizer | pp.24-25 | p.649 right column | pp.868-870 |
| 3. Light absorber (Ultraviolet ray absorber) | pp.25-26 | p.649 right column | p.873 |
| 4. Colorant image stabilizer | p.25 | p.650 right column | p.872 |
| 5. Film hardener | p.26 | p.651 left column | pp.874-875 |
| 6. Binder | p.26 | p.651 left column | pp.873-874 |
| 7. Plasticizer, lubricant | p.27 | p.650 right column | p.876 |
| 8. Auxiliary application agent (Surfactant) | pp.26-27 | p.650 right column | pp.875-876 |
| 9. Antistatic agent | p.27 | p.650 right column | pp.876-877 |
| 10. Matting agent | | | pp.878-879 |

The toner-image-receiving layer is formed by applying a coating solution that contains the polymer used for the toner-image-receiving layer with a wire coater or the like onto the support, and drying the coating solution. The film forming temperature of the aforesaid thermoplastic resin is no less than room temperature on the preservation prior to printing, and no more than 100° C. on fixing the toner particles.

The coated amount of the toner-image-receiving layer is preferably 1 to 20 g/m$^2$, more preferably 4 to 15 g/m$^2$, in terms of mass in dry state.

The thickness of the toner-image-receiving layer may be properly selected without particular limitations, for example, the thickness is preferably half or more, more preferably one to three times of the toner particle size, specifically, the thickness is preferably 1 to 50 μm, more preferably 1 to 30 μm, still more preferably 2 to 20 μm, in particular 5 to 15 μm.

Physical Properties of Toner-Image-Receiving Layer

The 180° peeling strength of the toner-image-receiving layer with the fixing member at the fixing temperature is preferably 0.1 N/25 mm or less, and more preferably 0.041 N/25 mm or less. The 180° separation strength can be measured based on the method described in JIS K6887 using the surface material of the fixing member.

It is preferred that the toner-image-receiving layer has a high degree of whiteness. This whiteness is measured by the method specified in JIS P 8123, and is preferably 85% or more. It is preferred that the spectral reflectance is 85% or more in the wavelength of 440 nm to 640 nm, and that the difference between the maximum spectral reflectance and minimum spectral reflectance in this wavelength is within 5%. Further, it is preferred that the spectral reflectance is 85% or more in the wavelength of 400 nm to 700 nm, and that the difference between the maximum spectral reflectance and the minimum spectral reflectance in the wavelength is within 5%.

Specifically, for the whiteness, the value of L* is preferably 80 or higher, more preferably 85 or higher, and still more preferably 90 or higher in a CIE 1976 (L*a*b*) color space. The color tint of the white color is preferably as neutral as possible. Regarding the color tint of the whiteness, the value of $(a^*)^2+(b^*)^2$ is preferably 50 or less, more preferably 18 or less and still more preferably 5 or less in a (L*a*b*) space.

The toner-image-receiving layer preferably serves to provide higher gloss on forming images. The gross level is preferably 60 or more, more preferably is 75 or more, still more preferably is 90 or more as 45° gloss in the entire region from white without the toner to the black at maximum concentration.

By the way, the gloss level is preferably 110 or less, since the gloss over 110 tends to be perceived as metal gloss and is not suitable in image quality. The gloss level may be determined in accordance with JIS Z8741 for example.

Preferably, the toner-image-receiving layer exhibits a high smoothness on fixing. The arithmetic average roughness (Ra) is preferably 3 μm or less, more preferably is 1 μm or less, and still more preferably is 0.5 μm or less, over the whole range from white without the toner, to the black at maximum concentration.

Arithmetic average roughness may be measured in accordance with JIS B 0601, JIS B 0651, and JIS B 0652.

It is preferred that the toner-image-receiving layer has one of the following physical properties, more preferred that it has a plurality of the following physical properties, and most preferred that it has all of the following physical properties.

(1) $T_m$ (Melting temperature) of the toner-image-receiving layer is 30° C. or more, and equal to or less than $T_m$+20° C. of the toner.

(2) The temperature at which the viscosity of the toner-image-receiving layer is $1\times10^5$ cp is 40° C. or higher, and lower than the corresponding temperature for the toner.

(3) At a fixing temperature of the toner-image-receiving layer, the storage elasticity modulus (G') is $1\times10^2$ Pa to $1\times10^3$ Pa, and the loss elasticity modulus (G") is $1\times10^2$ Pa to $1\times10^5$ Pa.

(4) The loss tangent (G"/G'), which is the ratio of the loss elasticity modulus (G") and the storage elasticity modulus (G') at a fixing temperature of the toner-image-receiving layer, is 0.01 to 10.

(5) The storage modulus (G') at a fixing temperature of the toner-image-receiving layer is from −50 to +2500, relative to the storage modulus (G') at a fixing temperature of the toner.

(6) The inclination angle on the toner-image-receiving layer of the molten toner is 50° or less, and particularly preferably 40° or less.

The toner-image-receiving layer preferably satisfies the physical properties described in JP-B No. 2788358, and JP-A No. 07-248637, No. 08-305067 and No. 10-239889.

The surface electrical resistance of the toner-image-receiving layer is preferably $1\times10^6$ to $1\times10^{15}$ Ω/cm$^2$ (at 25° C. and 65% RH). When the surface electrical resistance is less than $1\times10^6$ Ω/cm$^2$, the toner amount of the transferred toner on the toner-image-receiving layer is possibly not sufficient, and the resulting toner image tends to exhibit a lower density, whereas over $1\times10^{15}$ Ω/cm$^2$, excessive charge is induced more than necessary at the transferring period, as a result that the toner is not transferred sufficiently, the image density is lower, and dusts tends to attach on the electrophotographic-image-receiving layer due to static electricity during handling it. Further, miss feed, duplicated conveying, electric discharge trace, and miss transferring may be derived.

Incidentally, the surface electrical resistance may be determined in accordance with JIS K6911, i.e. the sample is allowed to stabilize its moisture in the ambient condition of 20° C. and 65% humidity for 8 hours or more, then the surface electrical resistance is measured after one minute of conducting period with 100 V of applied voltage, under the same ambient condition by means of R8340 (by Advantest K.K.).

[Other Layers]

The other layers in the electrophotographic material include for example a backing layer, surface protection layer, intermediate layer, undercoat layer, cushion layer, static control (prevention) layer, reflecting layer, color tone adjusting layer, storage property improving layer, antistick layer, anticurl layer, smoothing layer and the like. These layers may have a single layer structure or laminated structure.

Backing Layer

Preferably, in the electrophotographic-image-receiving sheet, a backing layer is disposed on the opposite surface to the surface on which the support is disposed; in order to confer a back surface output compatibility, and to improve a back surface output image quality, curling balance and paper conveying properties within the apparatus.

There is no particular limitation on the color of the backing layer. However, if the electrophotographic-image-receiving sheet according to the present invention is a double-sided output image receiving sheet where an image is formed also on the back surface, it is preferred that the backing layer is also white. It is preferred that the whiteness and spectral reflectance are 85% or more, for both of the top surface and the back surface.

To improve double-sided output compatibility, the backing layer may have an identical structure to that of the toner-image-receiving layer. The backing layer may comprise the various additives described earlier. Among these additives, matting agents and charge control agents are particularly suitable. The backing layer may be a single layer, or may have a laminated structure comprising two or more layers.

Further, if releasing oil is used for the fixing roller or the like, to prevent offset during fixing, the backing layer may have oil-absorbing properties.

The thickness of the backing layer is preferably 0.1 to 10 μm.

Surface Protective Layer

A surface protective layer may be disposed on the surface of the toner-image-receiving layer to protect the surface of the electrophotographic-image-receiving sheet, to improve storage properties, to improve handling ability, to facilitate writing ability, to improve paper transporting properties within an equipment, to confer anti-offset properties, or the like. The surface protective layer may comprise one layer, or two or more layers. In the surface protective layer, various thermoplastic resins or thermosetting resins may be used as binders, and are preferably the same types of resins as those of the toner-image-receiving layer. However, the thermodynamic properties and electrostatic properties are not necessarily identical to those of the toner-image-receiving layer, and may be individually optimized.

The surface protective layer may comprise the various additives described above which, may be utilized for the toner-image-receiving layer. In particular, in addition to the aforesaid releasing agent, matting agent and the like may be incorporated into the surface protective layer. The matting agent may be selected from various known agents.

From the viewpoint of fixing properties, it is preferred that the outermost surface layer of the electrophotographic material (which refers to, for example, the surface protective layer, if disposed) has good compatibility with the toner. Specifically, it is preferred that the contact angle with the molten toner is, for example, from 0° to 40°.

Contact Improving Layer

In the electrophotographic-image-receiving sheet, it is preferred to dispose a contact improving layer in order to improve the contact between the support and the toner-image-receiving layer. The contact improving layer may contain the various additives described above. Among these, cross-linking agents are particularly preferred to be blended in the contact improving layer. Furthermore, to improve accepting properties to toner, it is preferred that the electrophotographic-image-receiving sheet further comprises a cushion layer between the contact improving layer and the toner-image-receiving layer.

Intermediate Layer

An intermediate layer may for example be disposed between the support and a contact improvement layer, between a contact improvement layer and a cushion layer, between a cushion layer and a toner-image-receiving layer, or between a toner-image-receiving layer and a storage property improvement layer. In the case of an electrophotographic-image-receiving sheet comprising a support, a toner-image-receiving layer and an intermediate layer, the intermediate layer may of course be disposed for example between the support and the toner-image-receiving layer.

The thickness of the electrophotographic-image-receiving sheet may be properly selected depending on the application; for example, the thickness is preferably 50 to 550 μm, more preferably is 100 to 350 μm.

<Toner>

In the electrophotographic-image-receiving sheet, the toner-image-receiving layer receives toners during printing or copying.

The toner contains at least a binder resin and a colorant, and also may contain a releasing agent and other components, if necessary.

Binder Resin for Toner

Examples of the binder resin include vinyl monopolymer of styrenes such as styrene, parachlorostyrene, or the like; vinyl esters such as vinyl naphthalene, vinyl chloride, vinyl bromide, vinyl fluoride, vinyl acetate, vinyl propioniate, vinyl benzoate, vinyl butyrate, or the like; methylene aliphatic carboxylates such as methyl acrylate, ethyl acrylate, n-butyl acrylate, isobutyl acrylate, dodecyl acrylate, n-octyl acrylate, 2-chloroethyl acrylate, phenyl acrylate, á-methyl chloroacrylate, methyl methacrylate, ethyl methacrylate, butyl acrylate, or the like; vinyl nitriles such as acryloniotrile, methacrylonitrile, acrylamide, or the like; vinyl ethers such as vinyl methyl ether, vinyl ethyl ether, vinyl isobutyl ether, or the like; N-vinyl compounds such as N-vinyl pyrrole, N-vinylcarbazole, N-vinyl indole, N-vinyl pyrrolidone, or the like; and vinyl carboxylic acids such as methacrylic acid, acrylic acid, cinnamic acid, or the like. These vinyl monomers may be used either alone, or copolymers thereof may be used. Further, various polyesters may be used, and various waxes may be used in combination.

Among these resins, it is preferable to use a resin of the same type as the resin used for the toner-image-receiving layer of the present invention.

Colorant for Toner

The colorants known in the art may be employed without particular limitations. Examples of the colorant include various pigments such as carbon black, chrome yellow, Hansa yellow, benzidine yellow, threne yellow, quinoline yellow, permanent orange GTR, pyrazolone orange, Balkan orange, watch young red, permanent red, brilliant carmin 3B, brilliant carmin 6B, dippon oil red, pyrazolone red, lithol red, rhodamine B lake, lake red C, rose bengal, aniline blue, ultramarine blue, chalco oil blue, methylene blue chloride, phthalocyanine blue, phthalocyanine green, malachite green oxalate, or the like. Various dyes may also be added such as acridine, xanthene, azo, benzoquinone, azine, anthraquinone, thioindigo, dioxadine, thiadine, azomethine, indigo, thioindigo, phthalocyanine, aniline black, polymethine, triphenylmethane, diphenylmethane, thiazine, thiazole, xanthene, or the like. These colorants may be used alone or in combination.

It is preferred that the content of the colorant is 2 to 8% by mass. When the content of colorant is 2% or less by mass, the coloration is likely to be insufficient; when it is 8% or more by mass, transparency is likely to be deteriorated.

Releasing Agent for Toner

The releasing agent may be in principle any of the wax known in the art. Polar waxes containing nitrogen such as highly crystalline polyethylene wax having relatively low molecular weight, Fischertropsch wax, amide wax, urethane wax, and the like are particularly effective. For polyethylene wax, it is particularly effective when the molecular weight is 1000 or less, and is more preferable when the molecular weight is 300 to 1000.

Since the compounds containing urethane bonds tend to stay in a solid state due to the strength of the cohesive force of the polar groups even if the molecular weight is lower, and since the melting point may be set higher in view of the molecular weight, such compounds are suitable in general. The preferred molecular weight is 300 to 1000. The raw materials may be selected from various combinations such as a diisocyane acid compound with a mono-alcohol, a monoisocyanic acid with a mono-alcohol, dialcohol with mono-isocyanic acid, tri-alcohol with a monoisocyanic acid, and a triisocyanic acid compound with mono-alcohol. However, in order to prevent the molecular weight from becoming too large, it is preferable to combine a compound having multiple functional groups with another compound having one functional group, and it is important that the amount of functional groups be equivalent.

Examples of the monoisocyanic acid compound include dodecyl isocyanate, phenyl isocyanate and derivatives thereof, naphthyl isocyanate, hexyl isocyanate, benzyl isocyanate, butyl isocyanate, allyl isocyanate, and the like.

Examples of the diisocyanic acid compounds include tolylene diisocyanate, 4'-diphenylmethane diisocyanate, toluene diisocyanate, 1,3-phenylene diisocyanate, hexamethylene diisocyanate, 4-methyl-m-phenylene diisocyanate, isophorone diisocyanate, and the like.

Examples of the mono-alcohol include ordinary alcohols such as methanol, ethanol, propanol, butanol, pentanol, hexanol, heptanol, and the like.

Examples of the di-alcohols include numerous glycols such as ethylene glycol, diethylene glycol, triethylene glycol, trimethylene glycol, or the like; and examples of the tri-alcohols include trimethylol propane, triethylol propane, trimethanolethane, and the like. The present invention is not necessarily limited these examples, however.

These urethane compounds may be compounded with the resin or the colorant through a kneading operation, similarly to the conventional releasing agent, and may be applied as a type of kneaded-crushed toner. Further, in a case of using an emulsion polymerization cohesion scorification toner, the urethane compounds may be dispersed in water together with an ionic surfactant, polymer acid or polymer electrolyte such as a polymer base, heated above the melting point, and converted to fine particles by applying an intense shear in a homogenizer or pressure discharge dispersion machine to manufacture a releasing agent particle dispersion of 1 μm or less, which may be used together with a resin particle dispersion, colorant dispersion, or the like.

Other Components of Toner

The toner of the present invention may also contain other components such as internal additives, charge control agents, inorganic particles, or the like. Examples of the internal additives include metals such as ferrite, magnetite, reduced iron, cobalt, nickel, manganese, or the like; and alloys or magnets such as compounds containing these metals.

Examples of the charge control agent include dyes such as quaternary ammonium salt, nigrosine compounds, dyes made from complexes of aluminum, iron and chromium, or triphenylmethane pigments. The charge control agent can be selected from the ordinary charge control agent. Materials which are difficult to become solved in water are preferred from the viewpoint of controlling ionic strength which affects cohesion and stability during melting, and the viewpoint of less waste water pollution.

The inorganic fine particles may be any of the external additives for toner surfaces generally used, such as silica, alumina, titania, calcium carbonate, magnesium carbonate, tricalcium phosphate, or the like. It is preferred to disperse these with an ionic surfactant, polymer acid or polymer base.

Surfactants may also be used for emulsion polymerization, seed polymerization, pigment dispersion, resin particle dispersion, releasing agent dispersion, cohesion or stabilization thereof. For example, it is effective to use, in combination, anionic surfactants such as sulfuric acid ester salts, sulfonic acid salts, phosphoric acid esters, soaps, or the like; cationic surfactants such as amine salts, quaternary ammonium salts, or the like; or non-ionic surfactants such as polyethylene glycols, alkylphenol ethylene oxide adducts, polybasic alcohols, or the like. These may generally be dispersed by a rotary shear homogenizer or a ball mill, sand mill, dyno mill, or the like, all of which contain the media.

The toner may also contain an external additive, if necessary. Examples of the external additive include inorganic powder, organic particles, and the like. Examples of the inorganic particles include $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, CaO $SiO_2$, $K_2O$ $(TiO_2)_n$, $Al_2O_3.2SiO_2$, $CaCO_3$, $MgCO_3$, $BaSO_4$, $MgSO_4$, and the like. Examples of the organic particles include aliphatic acids, derivatives thereof, and the like, powdered metal salts thereof, and resin powders such as fluorine resin, polyethylene resin, acrylic resin, or the like. The average particle size of the powder may be, for example, 0.01 to 5 μm, and more preferably is 0.1 to 2 μm.

There is no particular limitation on the process of manufacturing the toner, but it is preferably manufactured by a process comprising the steps of (i) forming cohesive particles in a dispersion of resin particles to manufacture a cohesive particle dispersion, (ii) adding a fine particle dispersion to the cohesive particle dispersion so that the fine particles adhere to the cohesive particles, thus forming adhesion particles, and (iii) heating the adhesion particles which melt to form toner particles.

Physical Properties for Toner

It is preferred that the volume-average particle size of the toner of the present invention is from 0.5 to 10 μm.

If the volume-average particle size of the toner is excessively small, it may afford adverse effects on handling of the toner (supplementation, cleaning properties, fluidability, or the like), and the productivity of the particles may be deteriorated. On the other hand, if the volume-average particle size is excessively large, it may afford adverse effects on image quality and resolution, both of which lead to granulariness and transferring properties.

It is preferred that the toner of the present invention satisfies the aforesaid volume-average particle size range, and that the volume-average particle distribution index (GSDv) is 1.3 or less.

It is preferred that the ratio (GSDv/GSDn) of the volume-average polymer distribution index (GSDv) and the number-average particle distribution index (GSDn) is 0.95 or more.

It is preferred that the toner of the present invention satisfies the volume-average particle size range, and that the average value of the shape factor expressed by the following equation is 1.00 to 1.50.

$$\text{Shape factor}=(\pi\times L^2)/(4\times S)$$

wherein, "L" represents the length of the toner particle and "S" represents the projected area of the toner particle.

If the toner satisfies the above noted conditions, it has a desirable effect on image quality, and in particular, on granulariness and resolution. Also, there is less risk of dropout and blur accompanying with toner transferring, and less risk of adverse effect on handling properties, even if the average particle size is not small.

The storage elasticity modulus G' (measured at an angular frequency of ×10 rad/sec) of the toner itself is $1\times10^2$ Pa to $1\times10^5$ Pa at 150° C., which is suitable for improving image quality and preventing offset at a fixing step.

(Image Forming Process)

The image forming process according to the present invention comprises forming toner images and smoothening-fixing the image surface, and others depending on the requirements.

Toner Image Forming

In the toner image forming, toner images are formed on the inventive electrophotographic material.

The toner image forming may be properly selected without particular limitations, as long as toner images may be formed on the electrophotographic material; the way utilized in the conventional electrophotography may be also applied, for example, the direct transfer way wherein the toner image formed on the developing roller is transferred directly to the electrophotographic material, or the intermediate transfer belt way wherein the image is at first transferred to an intermediate transfer belt or the like, and then transferred to the image receiving material. From the viewpoint of environmental issue and high image quality, the intermediate transfer belt way is preferably employed.

Smoothening and Fixing Image Surface

In smoothing and fixing a toner image, the surface of the toner image is smoothened, after forming the toner image. In smoothing and fixing the toner image, smoothening and fixing the toner image is carried out through heating and pressing as well as cooling and peeling the toner image, by means of a smoothening and fixing unit.

The smoothening and fixing unit is equipped with a heating and pressing member, a belt member and a cooling device, cooling and peeling portion, and the other members depending on the requirements.

The heating and pressing member may be properly selected depending on the application; the fixing devices equipped in conventional electrophotographic apparatuses may be candidates, in particular, a pair of heat rollers, a combination of heat roller and pressure roller and like may be suitably exemplified.

The cooling device may be properly selected depending on the application, specifically, a cooling device, heatsink and the like may be selected from those capable of blowing cool air and adjusting the cooling temperature.

The cooling and peeling portion may be properly selected depending on the application, the site near the tension roll may be exemplified where the electrophotographic material peels itself from the belt owing to the stiffness or rigidity of the electrophotographic material.

When the toner image is brought into contact with the heating and pressuring member of the smoothening and fixing the image surface, preferably pressure is applied. The pressure may be applied in a suitably selected way, preferably pressurized by the application of nip pressure. The nip pressure is preferably from 1 to 100 kgf/cm$^2$ and more preferably form 5 to 30 kgf/cm$^2$ so as to form images with appropriate water resistance, high surface smoothness and high gloss. The heating temperature in the hot-pressing member is no less than the softening temperature of the thermoplastic resin in the toner-image-receiving layer, usually 80 to 200° C. is preferred although it depends on the polymer in the image receiving layer. The cooling temperature in the cooling device is preferably 80° C. or lower and more preferably from 20 to 80° C. with respect to the sufficient solidification of polymer layer in the toner-image-receiving layer.

The belt member comprises a support film and a releasing layer arranged on the support film.

The support film is not particularly restricted, as long as being heat resistant, and may be properly selected depending on the application; examples of the film material include polyimide (PI), polyethylene naphthalate (PEN), polyethylene terephthalate (PET), polyether ether ketone (PEEK), polyether sulfone (PES), polyether imide (PEI), and poly (parabanic acid) (PPA).

The releasing layer is preferably comprised of the material selected from the group consisting of silicone rubbers, fluorocarbon rubbers, fluorocarbon siloxane rubbers, silicone resins, and fluorocarbon resins.

Preferably, the belt member comprises a layer of fluorocarbon siloxane rubber on the surface of the belt member. Also such configuration is preferred that the layer of silicone rubber exists on the belt member, and the layer of fluorocarbon siloxane rubber exists on the surface of the silicone rubber.

As for the fluorocarbon siloxane rubber, such type is preferred that has at least one of perfluoroalkylether group and perfluoroalkyl group in the backbone.

As for the fluorocarbon siloxane rubber, a cured product of fluorocarbon siloxane rubber composition which contains the following components of (A) to (D) is preferable: (A) fluorocarbon polymer having a fluorocarbon siloxane expressed by the following formula (1) as its main component, and containing aliphatic unsaturated groups, (B) organopolysiloxane and/or fluorocarbon siloxane containing two or more ≡SiH groups in one molecule, wherein the content of the ≡SiH groups is 1 to 4 times of the aliphatic unsaturated groups in the fluorocarbon siloxane rubber, (C) filler, and (D) effective amount of catalyst.

The fluorocarbon polymer of aforesaid component (A) comprises a fluorocarbon siloxane containing a repeated unit expressed by the following formula (1) as its main ingredient, and also contains aliphatic unsaturated groups.

Formula (1)

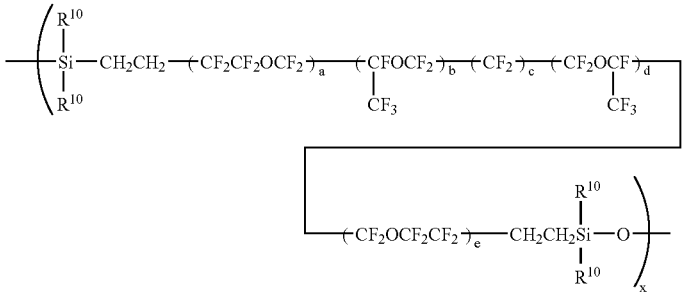

wherein, in the formula (1), $R^{10}$ represents a non-substituted or substituted monofunctional hydrocarbon group containing preferably 1 to 8 carbon atoms, preferably an alkyl group containing 1 to 8 carbon atoms or an alkenyl group containing 2 to 3 carbon atoms, and particularly preferably a methyl group.

The "a" and "e" represent respectively an integer of 0 or 1. The "b" and "d" represent respectively an integer of 1 to 4. The "c" represents respectively an integer of 0 to 8. The "x" represents respectively an integer of 1 or more, preferably 10 to 30.

An example of such component (A) is a compound expressed by the following formula (2).

Formula (2)

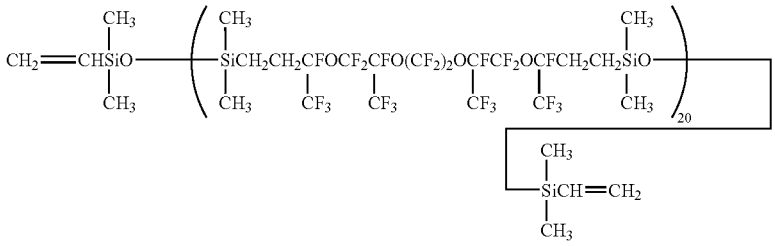

As for the component (B), an example of the organopolysiloxane comprising ≡SiH groups is organohydrogenpolysiloxane having at least two hydrogen atoms bonded to silicon atom in the molecule.

As for the fluorocarbon siloxane rubber composition, when the organocarbon polymer of component (A) comprises an aliphatic unsaturated group, the organohydrogenpolysiloxane may be preferably used as a curing agent. That is, the cured product is formed by an addition reaction between aliphatic unsaturated groups in the fluorocarbon siloxane, and hydrogen atoms bonded to silicon atoms in the organohydrogenpolysiloxane.

Examples of such organohydrogenpolysiloxane include the various organohydrogenpolysiloxanes used in an addition-curing type silicone rubber composition.

Preferably, the organohydrogenpolysiloxane is blended in such proportion that the number of "≡SiH groups" therein is at least one, and more preferably 1 to 5, relative to one aliphatic unsaturated hydrocarbon group in the fluorocarbon siloxane of component (A).

As for the fluorocarbon containing ≡SiH groups, $R^{10}$ in the formula (1), as one unit or entire of the compound, is a dialkylhydrogensiloxane group, the terminal group is an ≡SiH group such as dialkylhydrogensiloxane group, silyl group and the like. An example of the fluorocarbon is that expressed by the following formula (3).

Formula (3)

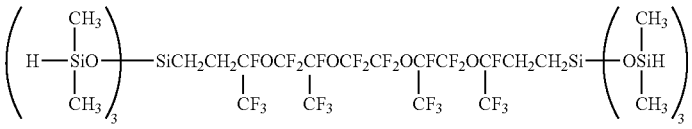

As for the filler of component (C), various fillers being utilized with conventional silicone rubbers may also be utilized. Examples of the filler include reinforcing fillers such as mist silica, precipitated silica, carbon powder, titanium dioxide, aluminum oxide, quartz powder, talc, sericite, bentonite and the like; and fiber fillers such as glass fiber, organic fibers and the like.

As for the catalyst of component (D), the catalysts known in the art as addition reaction catalyst may be exemplified such as chloroplatinic acid, alcohol-modified chloroplatinic acid, complexes of chloroplatinic acid and olefins, platinum black or palladium supported on a carrier as alumina, silica, carbon and the like, and Group VIII elements of the Periodic Table or compounds thereof such as complexes of rhodium and olefins, chlorotris(triphenylphosphine) rhodium (an Wilkinson catalyst), rhodium (III) acetyl acetonate and the like. These complexes are preferably utilized in a condition being dissolved in alcohol solvent, ether solvent, hydrocarbon solvent and the like.

The fluorocarbon siloxane rubber composition may be compounded various additives depending on the application. For example, dispersing agents such as diphenylsilane diol, hydroxy group terminated dimethylpolysiloxane of lower molecular weight, and hexamethyl disilazane; heat resistance improvers such as ferrous oxide, ferric oxide, cerium oxide, octyl acid iron, and the like; and colorants such as pigments or the like, may be compounded depending on the requirements.

The aforesaid belt member may be obtained by coating the surface of heat resistant support film with the fluorocarbon siloxane rubber composition, then heating and curing thereof. The composition may be diluted to form a coating solution with a solvent such as m-xylene hexafluoride, benzotrifluoride and the like. The temperature and period of the heating and curing may be suitably selected depending on the type of support film, process for manufacturing and the like, usually from the ranges of the 100° C. to 500° C. and 5 seconds to 5 hours.

A thickness of the releasing layer on the belt may be suitably selected; the thickness is preferably 1 to 200 μm, and more preferably is 5 to 150 μm, so as to obtain good fixing properties for an image, and also to prevent the toner separation and offset of the toner components.

An exemplary belt fixing device in the image forming apparatus adapted to the present invention will be specifically explained with reference to FIG. 1 in the following.

Initially a toner 12 is transferred onto an electrophotographic material 1 by means of an image forming apparatus (not shown). The electrophotographic material 1, on which the toner 12 adheres, is transported to point A by a conveying device (not shown), and is passed between heat roller 14 and pressure roller 15, and is heated and pressurized to a temperature (fixing temperature) and pressure at which a toner-image-receiving layer of the electrophotographic material 1 or the toner 12 is sufficiently softened.

The fixing temperature means the surface temperature of the toner-image-receiving layer measured at the position of the heat roller 14, pressure roller 15 and nip part at point A, and is preferably 80 to 190° C., and more preferably is 100 to 170° C. The pressure means the pressure at the surface of the toner-image-receiving layer measured at heat roller 14, pressure roller 15 and nip part, and is preferably 1 to 10 $kgf/cm^2$, more preferably is 2 to 7 $kgf/cm^2$.

While the electrophotographic material 1 is heated and pressurized, and is transported to the cooling device 16 by fixing belt 13, the releasing agent (not shown) dispersed separately in the toner-image-receiving layer is sufficiently heated and melted, and migrates onto the surface of the toner-image-receiving layer. The migrated releasing agent forms a layer or film of releasing agent at the surface of the toner-image-receiving layer. Then, the electrophotographic material 1 is transported to the cooling device 16 by means of fixing belt 13, and is cooled to no more than the softening temperature or the glass transition temperature plus 10° C. of the polymer in the toner-image-receiving layer and/or the binder resin used in the toner, which is preferably 20 to 80° C., and more preferably is ambient temperature of about 25° C. In this way, the layer or film of the releasing agent presented at the surface of the toner-image-receiving layer is cooled and solidified to form the layer of the releasing agent.

The cooled electrophotographic material 1 is then transported to point B by means of fixing belt 13. The fixing belt 13 is spanned and moved around tension roller 17. As such, electrophotographic material 1 peels or separates from fixing belt 13 at point B. Preferably, the diameter of the tension roller is designed to be suitably smaller such that the electrophotographic-image-receiving sheet peels or separates itself from the belt with its own rigidity or stiffness.

Figure 2:
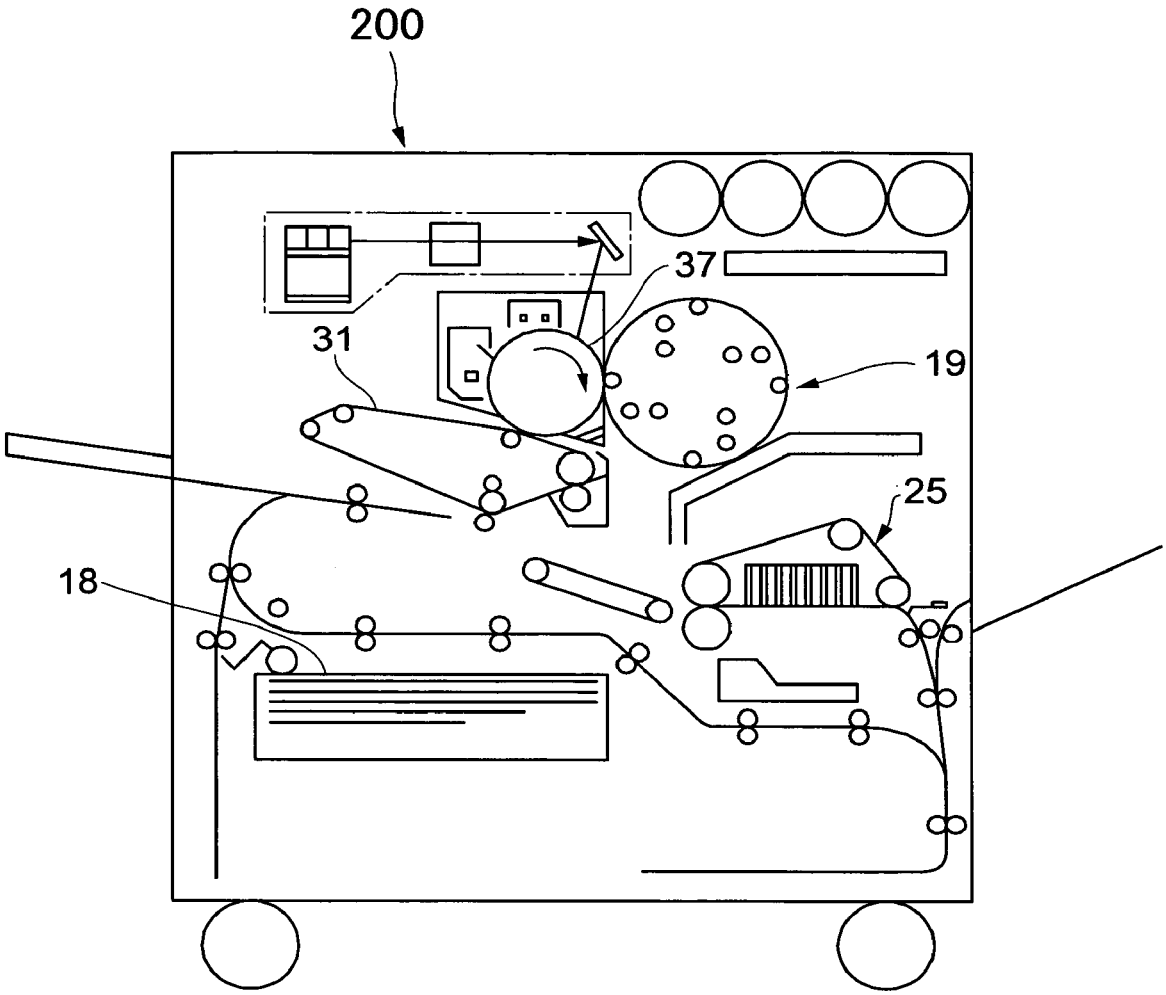
FIG. 2 schematically shows an exemplary image forming available in the process for forming an image according to the present invention.
Figure 3:
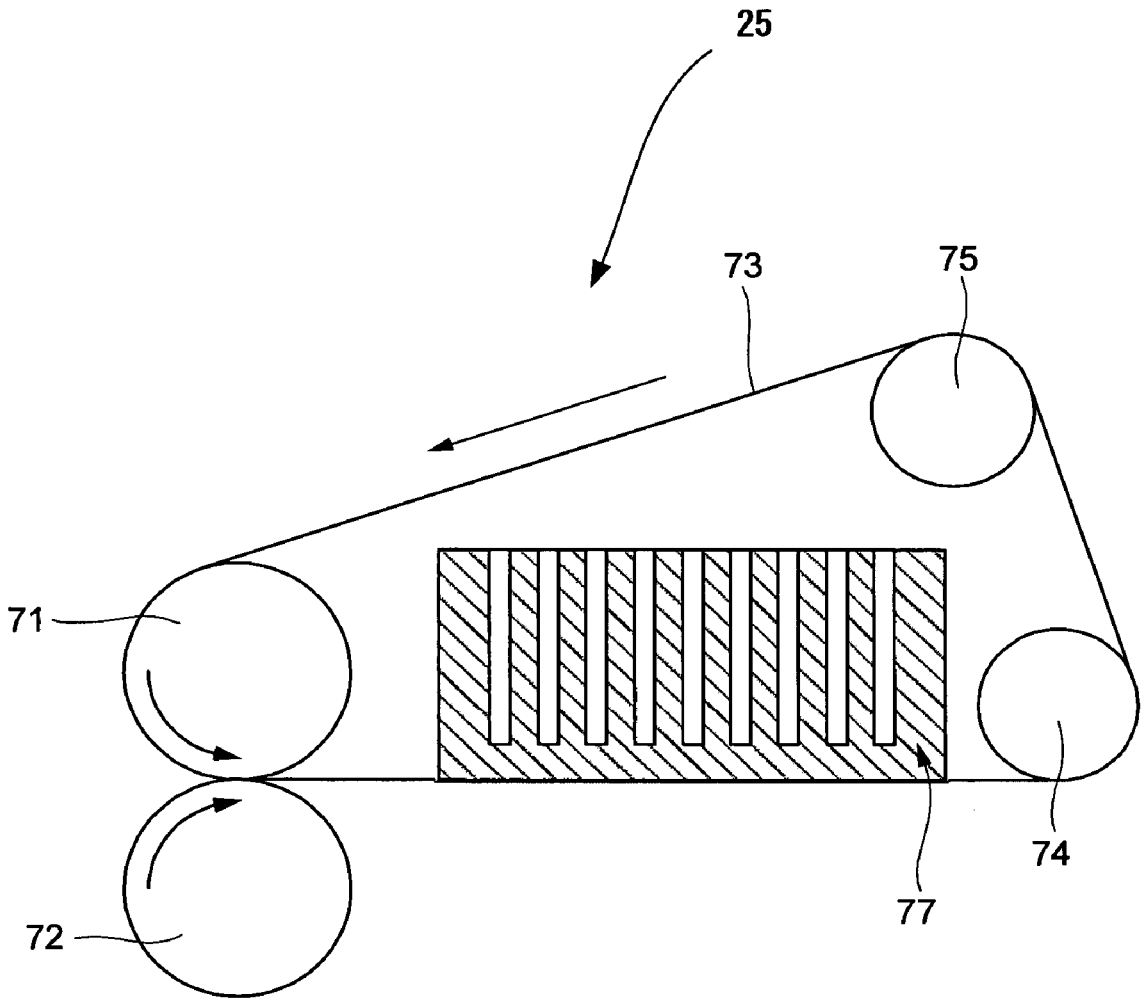
FIG. 3 schematically and exemplarily shows a unit for smoothening and fixing the image surface.

Further, the smoothening and fixing unit for image surface as shown in FIG. 3 may be modified and employed as a fixing unit in the electrophotographic apparatus shown in FIG. 2 such as a full-color laser printer DCC-500 (trade name, available from Fuji Xerox Co., Ltd., Japan).

With reference to FIG. 2, the image forming apparatus 200 includes photoconductive drum 37, development device 19, intermediate transfer belt 31, electrophotographic material 18, and fixing unit 25 (smoothening and fixing unit for image surface).

FIG. 3 shows fixing device 25 (smoothening and fixing unit for image surface) to be arranged inside the image forming apparatus 200 of FIG. 2.

As shown in FIG. 3, the smoothening and fixing unit for image surface 25 comprises heat roller 71, releasing roller 74, tension roller 75, endless belt 73 supported rotatably by heat roller 71, and pressure roller 72 pressing the heat roller 71 through endless belt 73.

Cooling heatsink 77, which forces endless belt 73 to cool, is arranged inside the endless belt 73 between heat roller 71 and releasing roller 74. The cooling heatsink 77 constitutes the cooling and sheet-conveying unit for cooling and conveying the electrophotographic material.

In smoothening and fixing unit for image surface 25 as shown in FIG. 3, an electrophotographic-transferring sheet, bearing a transferred and fixed color toner image on its surface, is introduced into a pressing portion or nip portion, between heat roll 71 and pressure roll 72 that presses heat roll 71 through endless belt 73, so that the color toner image faces heat roller 71. The color toner image is heated, fused and thereby fixed on the electrophotographic material while the electrophotographic material passes through the pressing portion between the heat roller 71 and the pressure roller 72.

Thereafter, the toner is heated to about 120 to 130° C. at the pressing portion between heat roller 71 and pressure roller 72 and is thereby fused and fixed to the image-receiving layer of the electrophotographic material. The electrophotographic material with the color toner image fixed on its image-receiving layer is then conveyed with the endless belt 73 while its surface image-receiving layer is in intimate contact with the surface of endless belt 73. During conveying, endless belt 73 is forcedly cooled by the cooling heatsink 77 to thereby cool and solidify the color toner image and the image-receiving layer, and the electrophotographic material is then peeled or separated from the endless belt 73 due to its own rigidity or stiffness with the action of releasing roller 74.

The remaining toner and other unnecessary substances on the surface of the endless belt 73 after the completion of the peeling or separating procedure are to be removed by a cleaner (not shown) for the subsequent smoothening and fixing the image surface.

In accordance with the inventive image-forming process, even when an oil-less apparatus is utilized without fixing oil, the releasing properties of the electrophotographic material and toner, or the offset of the electrophotographic material and the toner component may be assured, stable paper feed may be achieved, the film-forming performance may be improved, and images with high quality similar to silver halide photography may be formed with excellent surface conditions and superior gloss.

<Silver Halide Photographic Material>

An example of the silver halide photographic materials is one which comprises a support and at least an image forming layer arranged on the support and is used in a silver halide photographic process in which a printed and light-exposed sheet for silver halide photography is immersed in and transported through plural treatment tanks to thereby subjecting the sheet color development, bleaching and image-fixing, and washing with water and is then dried.

<Inkjet Recording Material>

An example of the inkjet recording materials is one which comprises a support and a coloring-material-receiving layer arranged on the support. The coloring-material-receiving layer may receive a liquid ink such as a water-based ink using a dye or pigment as a coloring material and an oily ink or a solid ink that is solid at ordinary temperature and is fused and liquefied before image formation.

<Thermal Transfer Material>

An example of the thermal transfer materials is one which comprises a support and at least a hot-melt ink layer as an image forming layer arranged on the support and is used in a fusion transfer process in which an ink is transferred from the hot-melt ink layer to a thermal transfer sheet by heating with a thermal head.

<Thermosensitive Material>

An example of the thermosensitive materials is a thermosensitive coloring material comprising a support and at least a heat coloring or heat developing layer on the support and is used in a thermo-autochrome process (TA process). In the TA process, an image is formed by heating with a thermosensitive head, image-fixing by application of ultraviolet rays, and repeating these procedures.

<Sublimation Transfer Material>

An example of the sublimation transfer materials is one which comprises a support and at least an ink layer containing a thermally diffusible dye or sublimation dye arranged on the support and is used in a sublimation transfer process in which the thermally diffusible dye is transferred from the ink layer to a image receiving sheet for thermosensitive transfer recording by heating with a thermal head.

The image-recording material in accordance with the present invention is preferably applied to an electrophotographic material, thermosensitive material, inkjet recording material, sublimation transfer material, silver halide photographic material, thermal transfer material, and the like owing to its high image quality, high gloss and less occurrences of curling of the image-recording surface.

The present invention will be illustrated in more detailed with reference to examples given below, but these are not to be construed as limiting the present invention. All percentages and parts are by weight unless indicated otherwise.

EXAMPLE 1

Preparation of Raw Paper

A broadleaf kraft pulp (LBKP) was beaten to 300 ml (Canadian standard freeness, C.S.F.) by a disk refiner, and adjusted to a fiber length of 0.58 mm to prepare a pulp paper material. To the pulp paper material, 1.2% by mass of cationic starch, 0.5% by mass of alkyl ketene dimer (AKD), 0.3% by mass of anion polyacrylamide, 0.2% by mass of epoxidized fatty acid amide (EFA), and 0.3% by mass of Polyamide polyamine epichlorhydrin were added based on the mass of pulp.

Note: In the alkyl ketene dimer (AKD), the alkyl moiety is derived from fatty acids mainly containing behenic acid. In the epoxidized fatty acid amide (EFA), the fatty acid moiety is derived from fatty acids mainly containing behenic acid.

From the resulting pulp paper material, a raw paper of 150 $g/m^2$ was prepared by means of a Fortlinear paper machine. In addition, 1.0 $g/m^2$ of PVA (polyvinyl alcohol) and 0.8 $g/m^2$ of $CaCl_2$ were added on the way of drying in the Fortlinear paper machine by means of a size press device.

At the end of the paper preparation, the density was adjusted to 1.01 $g/cm^3$ by means of a soft calender. The raw paper was conveyed in a condition that the side of the raw paper, on which the toner-image-receiving layer is to be provided, contacts with the metal roller. The surface temperature of the metal roller was 140° C. In the resulting raw paper, the whiteness level was 91%, the Oken type smoothness was 265 seconds, and the Stökigt sizing degree was 127 seconds.

The resulting raw paper strip was subjected to corona discharge at output power of 17 kW. Then, a single layer of polyethylene resin having a composition shown in Table 2 was extruded and laminated onto the back side of the raw paper at a temperature of discharged fused film of 320° C. and at a line speed of 250 m/minute using a cooling roll with a surface matte roughness of 10 μm, thereby a back side polyethylene resin layer of 22 μm thick was provided.

TABLE 2

| Composition | MFR (g/10 min) | Density ($g/cm^3$) | Amount of additive (% by mass) |
|---|---|---|---|
| HDPE | 12 | 0.967 | 70 |
| LDPE | 3.5 | 0.923 | 30 |

HDPE: High Density Polyethylene
LDPE: Low Density Polyethylene

Then, a single layer of a master batch mixture was extruded and laminated onto the front side of the raw paper, on which the toner-image-receiving layer is to be formed, at a line speed of 250 m/minute using a cooling roll with a surface matte roughness of 0.7 μm, thereby a front side polyethylene resin layer 29 μm thick was provided. The mixture of master batches had a final composition shown in Table 4, contained first master batch pellets containing the LDPE as in Table 3 and titanium dioxide ($TiO_2$) in a composition shown in Table 3, and second master batch pellets containing 5% by mass of ultramarine blue.

Then, the front side of the polyethylene resin layer was exposed to corona discharge at power of 18 kW and the back side of the polyethylene resin layer was exposed at power of 12 kW; then a gelatin undercoat layer was formed on the front side, and an antistatic undercoat layer containing colloidal alumina, colloidal silica and polyvinyl alcohol (PVA) was formed on the back side to prepare a support.

TABLE 3

| Composition | Content (% by mass) |
|---|---|
| LDPE ($\rho$ = 0.921 g/cm$^3$) | 37.98 |
| Anatase titanium dioxide | 60 |
| Zinc stearate | 2 |
| Antioxidant | 0.02 |

TABLE 4

| Composition | Amount of additive (% by mass) |
|---|---|
| LDPE ($\rho$ = 0.921 g/cm$^3$) | 67.7 |
| Anatase titanium dioxide | 30 |
| Zinc stearate | 2 |
| Ultramarine | 0.3 |

Then on the resulting support, the composition for undercoat layer indicated later was coated such that the film thickness was 5 μm after drying. Then on the undercoat layer, the composition for toner-image-receiving layer consisting of the following ingredients was coated such that the film thickness was 10 μm after drying. As a result, the electrophotographic-image-receiving layer of Example 1 was prepared.

| Composition for Undercoat Layer | |
|---|---|
| Acryl latex (Highloss HE-1335, Seiko-Chemical Co.,) | 100 g |
| Water | 210 g |
| **Composition for Toner-Image-Receiving Layer** | |
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A464S, counter cation: ammonia, volume-average particle size: 129 nm, by UNITIKA Ltd.
*2)Alkox R150, weight-average molecular weight: 100,000, by Meisei Chemical Works, Ltd.
*3)Serozol 524, by Chukyo Yushi Co.
*4)TIPAQUE ™ RA-220, by Ishihara Sangyo Kaisha, Ltd.

The volume-average particle size of the water-dispersible polyester emulsion was determined by means of Microtrac Particle Size Analyzer UPA150 (MODEL No. 9340, Nikkiso Co., Ltd.), following to dilute the water-dispersible polyester emulsion with de-ionized water to the concentration of 0.1% by mass as solid content.

EXAMPLE 2

The electrophotographic-image-receiving sheet of Example 2 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |

-continued

| Composition for Toner-Image-Receiving Layer | |
|---|---|
| Carnauva wax*3) | 10 g |
| Titanium dioxide*4) | 12 g |
| Water | 550 g |

*1)KZA-A464S, counter cation: ammonia, volume-average particle size: 129 nm, by UNITIKA Ltd.
*2)Alkox R1000, weight-average molecular weight: 300,000, by Meisei Chemical Works, Ltd.
*3)Serozol 524, by Chukyo Yushi Co.
*4)TIPAQUE ™ RA-220, by Ishihara Sangyo Kaisha, Ltd.

EXAMPLE 3

The electrophotographic-image-receiving sheet of Example 3 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-9294S, counter cation: ammonia, volume-average particle size: 135 nm, by UNITIKA Ltd.
*2)Alkox R1000, weight-average molecular weight: 300,000, by Meisei Chemical Works, Ltd.
*3)Serozol 524, by Chukyo Yushi Co.
*4)TIPAQUE ™ RA-220, by Ishihara Sangyo Kaisha, Ltd.

EXAMPLE 4

The electrophotographic-image-receiving sheet of Example 4 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A437S, counter cation: triethyl amine, volume-average particle size: 106 nm, by UNITIKA Ltd.
*2)Alkox R400, weight-average molecular weight: 200,000, by Meisei Chemical Works, Ltd.
*3)Serozol 524, by Chukyo Yushi Co.
*4)TIPAQUE ™ RA-220, by Ishihara Sangyo Kaisha, Ltd.

EXAMPLE 5

The electrophotographic-image-receiving sheet of Example 5 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A437S, counter cation: triethyl amine, volume-average particle size: 111 nm, by UNITIKA Ltd.
*2)Alkox R1000, weight-average molecular weight: 300,000, by Meisei Chemical Works, Ltd.
*3)Serozol 524, by Chukyo Yushi Co.
*4)TIPAQUE ™ RA-220, by Ishihara Sangyo Kaisha, Ltd.

EXAMPLE 6

The electrophotographic-image-receiving sheet of Example 6 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A537S, counter cation: triethyl amine, volume-average particle size: 55 nm, by UNITIKA Ltd.
*2)Alkox E30, weight-average molecular weight: 400,000, by Meisei Chemical Works, Ltd.
*3)Serozol 524, by Chukyo Yushi Co.
*4)TIPAQUE ™ RA-220, by Ishihara Sangyo Kaisha, Ltd.

EXAMPLE 7

The electrophotographic-image-receiving sheet of Example 7 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A537S, counter cation: triethyl amine, volume-average particle size: 125 nm, by UNITIKA Ltd.
*2)Alkox R1000, weight-average molecular weight: 300,000, by Meisei Chemical Works, Ltd.
*3)Serozol 524, by Chukyo Yushi Co.
*4)TIPAQUE ™ RA-220, by Ishihara Sangyo Kaisha, Ltd.

COMPARATIVE EXAMPLE 1

The electrophotographic-image-receiving sheet of Comparative Example 7 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A464S, counter cation: triethyl amine, volume-average particle size: 129 nm, by UNITIKA Ltd.
*2)Alkox E60, weight-average molecular weight: 1000,000, by Meisei Chemical Works, Ltd.
*3)Serozol 524, by Chukyo Yushi Co.
*4)TIPAQUE ™ RA-220, by Ishihara Sangyo Kaisha, Ltd.

COMPARATIVE EXAMPLE 2

The electrophotographic-image-receiving sheet of Comparative Example 2 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A437S, counter cation: triethyl amine, volume-average particle size: 35 nm, by UNITIKA Ltd.
*2)Alkox E30, weight-average molecular weight: 400,000, by Meisei Chemical Works, Ltd.
*3)Serozol 524, by Chukyo Yushi Co.
*4)TIPAQUE ™ RA-220, by Ishihara Sangyo Kaisha, Ltd.

COMPARATIVE EXAMPLE 3

The electrophotographic-image-receiving sheet of Comparative Example 3 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A437S, counter cation: triethyl amine, volume-average particle size: 106 nm, by UNITIKA Ltd.
*2)Alkox E60, weight-average molecular weight: 1000,000, by Meisei Chemical Works, Ltd.
*3)Serozol 524, by Chukyo Yushi Co.
*4)TIPAQUE ™ RA-220, by Ishihara Sangyo Kaisha, Ltd.

COMPARATIVE EXAMPLE 4

The electrophotographic-image-receiving sheet of Comparative Example 4 was prepared in the same manner as Example 1, except that the following composition for toner-image-receiving layer was employed in place of that employed in Example 1.

| Composition for Toner-Image-Receiving Layer | |
|---|---|
| Water-dispersible polyester emulsion*1) | 100 g |
| Polyethylene oxide*2) | 17 g |
| Carnauva wax*3) | 10 g |
| Titanium dioxide*4) | 12 g |
| Water | 550 g |

*1)KZA-A537S, counter cation: triethyl amine, volume-average particle size: 125 nm, by UNITIKA Ltd.
*2)Alkox E60, weight-average molecular weight: 1000,000, by Meisei Chemical Works, Ltd.
*3)Serozol 524, by Chukyo Yushi Co.
*4)TIPAQUE ™ RA-220, by Ishihara Sangyo Kaisha, Ltd.

Concerning the Examples 1 to 7 and Comparative Examples 1 to 4, flocculation, surface condition of the coated layer (film-forming performance), and glossiness were evaluated as follows. The results are summarized in Table 5.

<Evaluation of Flocculation>

Figure 4:
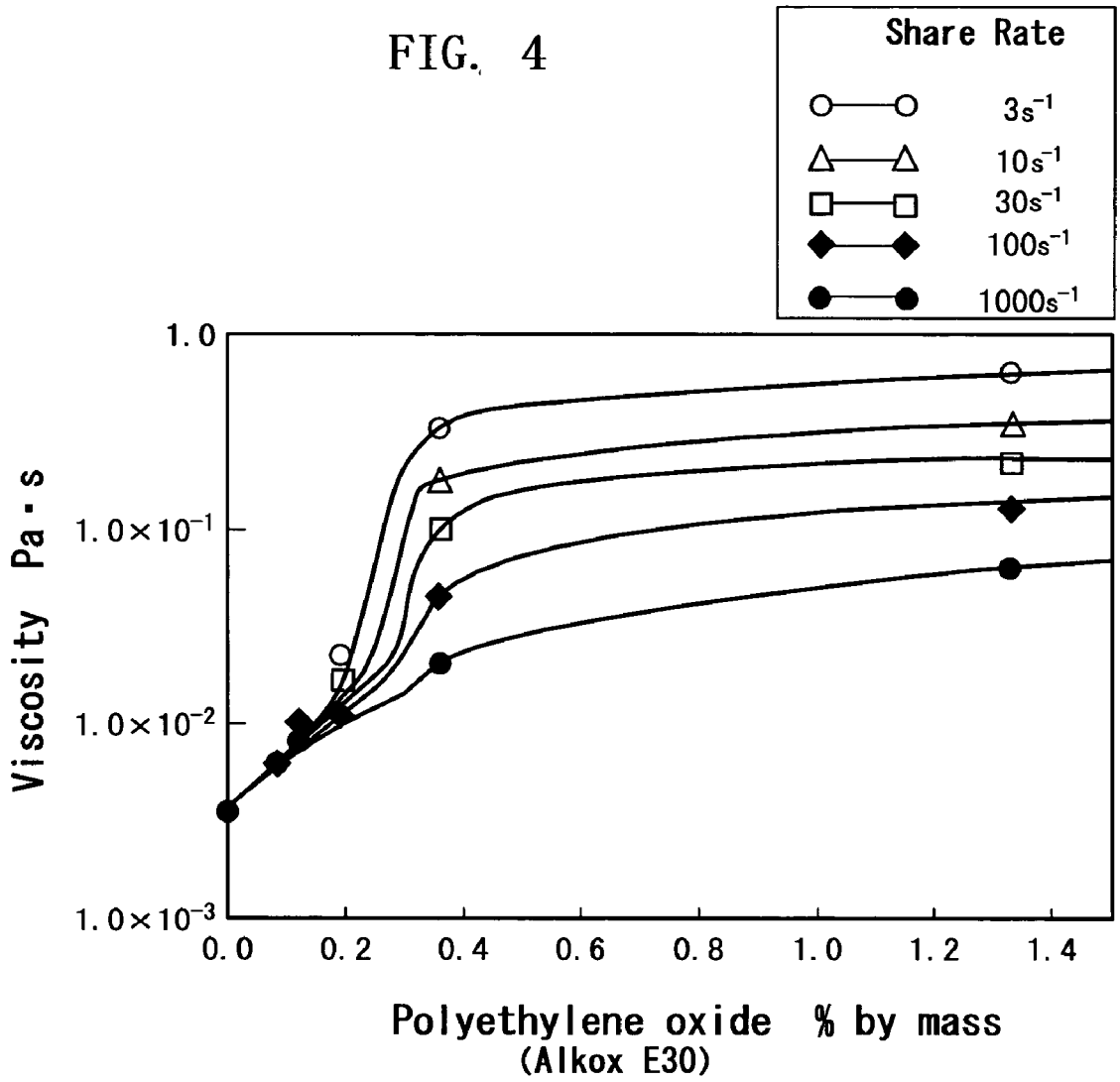
FIG. 4 shows the effects on viscosity with respect to the added amount of polyethylene oxide to the water-dispersible polyester emulsion, employed in Examples, and with respect to the share rate.
Figure 5:
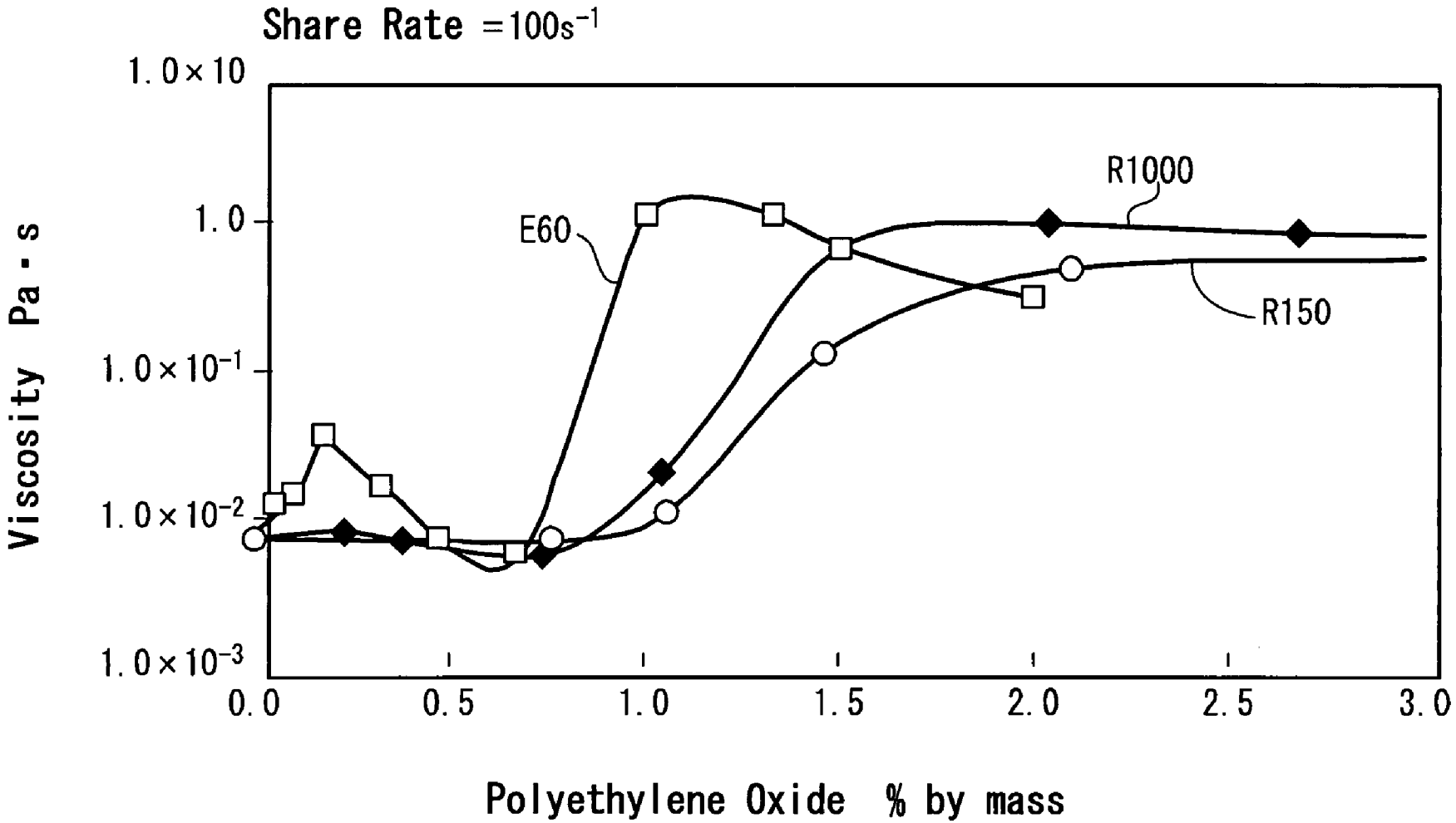
FIG. 5 shows the effect on viscosity with respect to the added amount of polyethylene oxide to the water-dispersible polyester emulsion employed in Examples.
Figure 6:
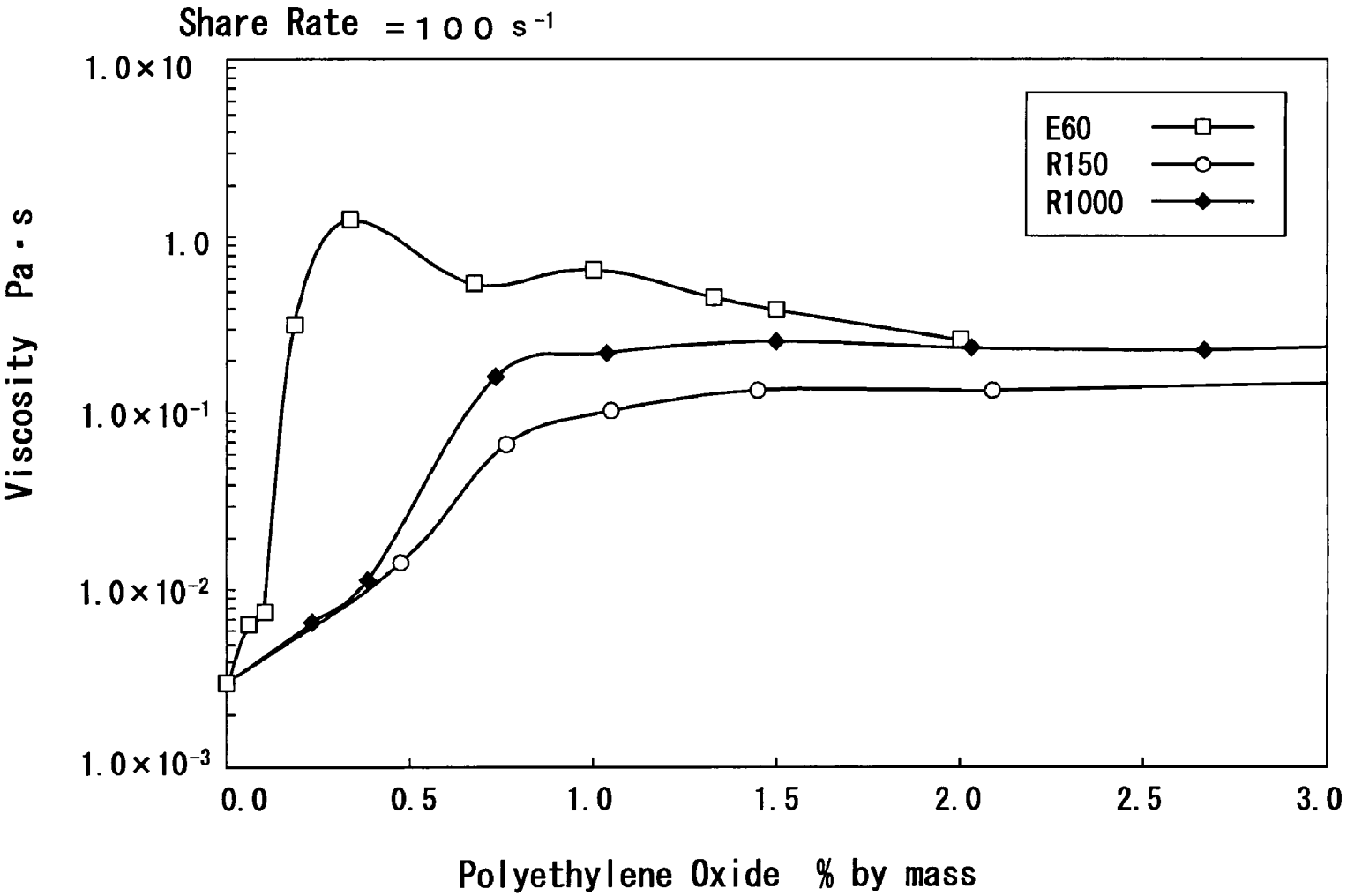
FIG. 6 shows the effect on viscosity with respect to the added amount of polyethylene oxide to the water-dispersible polyester emulsion employed in Examples.

The flocculation was determined through measuring viscosities of the water-dispersible emulsions which were blended various amount of polyethylene oxide under the respective combinations of water-dispersible polyester emulsions and water-soluble polymer compounds (polyethylene oxide) in Examples 1 to 7 and Comparative Examples 1 to 4. The viscosities were measured by means of Rheometer (Dynalyzer, Rheologica Co.), in the condition of gap distance 0.5 mm between parallel plates of 20 mm diameter, variable share rate of 1 to 1000 $s^{-1}$, and 25° C. of constant temperature. The evaluation whether or not flocculation exists was derived from the viscosity curve related with the added amount of water-soluble polymer compounds. The depletion flocculation was determined on the grounds that the viscosities depend on the share rate, as shown in FIG. 4. The adsorption flocculation was determined on the grounds that the viscosities increase rapidly from certain concentration as shown in FIG. 5, in addition that the local maximum of viscosities appears at lower concentration region as shown in FIG. 6.

Further, the depletion flocculation was evaluated on the grounds of microscope observation whether or not the structure of coagulated particles is recognized at ×200 to 500 magnification; in addition was evaluated whether or not a rapid decrease on viscosity curve appears till it is diluted into two times.

Measurement of Adsorbed Amount

Whether the depletion flocculation or adsorption flocculation may also be determined through the adsorbed amount of water-soluble polymer compound. That is, the type of flocculation was determined by blending the water-dispersible polyester emulsion and the water-soluble polymer compound (polyethylene oxide) in aqueous medium in the mass ration of water-dispersible polyester emulsion/water-soluble polymer compound: 100/17, the amount of water-soluble polymer compound (polyethylene oxide) dissolved in the supernatant after centrifugation being analyzed quantitatively by means of NMR, then the adsorbed amount of polyethylene oxide being determined based on the added amount of polyethylene oxide, and then being evaluated with reference to the following standards.

[Evaluation Standard of Adsorbed Amount]

Adsorbed Amount (vs. added amount)

No Flocculation: less than 2% by mass

Depletion Flocculation: more than 2 to less than 5% by mass

Adsorption Flocculation: 30% or more by mass

By the way, other publicly known process may determine the condition of flocculation corresponding to the range of 5 to 30% by mass.

<Evaluation of Coated Surface Condition (Film-Forming Performance)>

The coating liquids for the respective toner-image-receiving layers of Examples 1 to 7 and Comparative Examples 1 to 4 were coated on supports, and the surface condition after drying was visually evaluated with reference to the following standard.

Evaluation Standard on Surface Condition

A—No Crazing, Cracking, or Irregularity on the Coated Surface

B—Slight Crazing, Cracking, or Irregularity on the Coated Surface

C—Some Crazing, Cracking, or Irregularity on the Coated Surface

<Evaluation of Glossiness>

The respective electrophotographic-image-receiving sheets of aforesaid Examples and Comparative Examples were subjected to image forming by means of an electrophotographic apparatus comprising a fixing belt, then the glossiness was determined.

Process for Measuring Glossiness

The respective electrophotographic-image-receiving sheets were subjected to printing for 10 cm square areas in B/W condition at six stages (0, 20, 40, 60, 80, 100%) by means of a printer as described following, the glossiness was measured (measurement at 20°) for the resulting images by means of Digital Variable Gloss Meter (UGV-5G, by Sugatest Co.) in accordance with JIS Z8741, then the minimum values were recorded.

Specifically, white solid, gray (in the image, R=G=B=50%), black (100%), and a portrait image of woman were employed as the printing images. As for the image forming apparatus, the color laser printer (C-2220, by Fuji Xerox Co., Ltd.) comprising a belt fixing device quipped with a fixing belt as shown in FIG. 3 was utilized.

As for the substrate for fixing belt, silicone rubber primer DY39-115 (by Dow Corning Toray Silicone Co., Ltd.) was applied on a polyimide base layer as the base for the fixing belt, and after being allowed with air-drying for 30 minutes, an application solution prepared from 100 parts by mass of DY-35-796AB, which is a silicone rubber precursor, and 30 parts by mass of n-hexane was applied by immersion to form a coating. Then, a primary vulcanization was conducted at 120° C. for 10 minutes, thereby a silicone rubber layer of 40 μm thick was formed.

On the silicone rubber layer, a coating liquid prepared from 100 parts by mass of SIFEL 610 (precursor of fluorocarbon siloxane rubber, by Shin-Etsu Chemical Co., Ltd.) and 20 parts by mass of fluorine solvent (a mixture solvent of m-xylenehexafluoride, perfluoroalkane, and perfluoro-2-butyltetrahydrofuran) was applied by immersion to form a coating. Then, a primary vulcanization was conducted at 120° C. for 10 minutes, and a secondary vulcanization was conducted at 180° C. for 4 hours, thereby a fluorocarbon siloxane rubber layer having a thickness of 20 μm was formed, and the fixing belt was made.

The printing rate of the image forming apparatus was set 30 mm/sec in principle; as for the fixing temperature of toner, the temperature of the heat roller was set to 155° C., and the temperature of the pressure roller was set to 130° C. The aforesaid portrait image, and 5 cm square patterns of white solid, gray, and black were transferred respectively using the image forming apparatus.

TABLE 5

| | Evaluation of Flocculation | Surface Condition of Coating | Glossiness |
|---|---|---|---|
| Ex. 1 | No | A | 86 |
| Ex. 2 | No | A | 88 |
| Ex. 3 | No | A | 85 |
| Ex. 4 | No | A | 89 |
| Ex. 5 | No | A | 85 |
| Ex. 6 | No | A | 88 |
| Ex. 7 | No | A | 86 |
| Com. Ex. 1 | Adsorption | C | 85 |
| Com. Ex. 2 | No | C | 78 |
| Com. Ex. 3 | Depletion | C | 83 |
| Com. Ex. 4 | Depletion | C | 84 |

From the results of Table 5, it is demonstrated that Examples 1 to 7 entirely resulted in properly coated surface conditions, i.e. the film-forming performance was appropriate, without causing depletion or adsorption flocculation at all. On the contrary, Comparative Example 1 resulted in adsorption flocculation, Comparative Examples 2 and 3 resulted in depletion flocculation, and Comparative Examples 1 to 4 respectively resulted in crazing, cracking, or irregularity on the coated and dried surface, therefore the surface conditions were inappropriate, i.e. the film-forming performance was poor.

In accordance with the present invention, various problems in the art may be solved, the flocculation in the coating liquid for image-recording layer, containing water-dispersible emulsion and water-soluble polymer compound, may be prevented, the stability may be improved, the film-forming performance may be enhanced, and the image-recording material may be provided with high quality and superior surface conditions.

What is claimed is:

1. An image-recording material comprising:

a support, and at least one image-recording layer on the support, wherein the image-recording layer is formed from a water-dispersible emulsion of which volume-average particle size is 55 nm or more and a water-soluble polymer compound of which weight-average molecular weight (Mw) is 400,000 or less.

2. The image-recording material according to claim 1, wherein the image-recording layer is formed from a water-dispersible emulsion of which volume-average particle size is 55 nm to 180 nm, and a water-soluble polymer compound of which weight-average molecular weight (Mw) is 100,000 to 400,000.

3. The image-recording material according to claim 1, wherein the mass ratio of the water-dispersible emulsion to the water-soluble polymer compound (water-dispersible emulsion: water-soluble polymer compound) is 1:0.01 to 1:1.

4. The image-recording material according to claim 1, wherein the water-dispersible emulsion is a water-dispersible polyester emulsion.

5. The image-recording material according to claim 1, wherein the water-soluble polymer compound is polyethyleneoxide.

6. The image-recording material according to claim 1, wherein the support is selected from the group consisting of raw paper, synthetic paper, synthetic resin sheet, coated paper, and laminated paper.

7. The image-recording material according to claim 6, wherein the support comprises a raw paper, and polyolefin resin layers coated on both sides of the raw paper.

8. The image-recording material according to claim 1, wherein the image-recording material is at least one of the materials selected from the group consisting of an electrophotographic material, a thermosensitive coloring material an inkjet recording material, a sublimation transfer material, a silver halide photographic material, and a thermal transfer material.

9. The image-recording material according to claim 8, wherein the image-recording material is an electrophotographic material comprising a support and at least one toner-image-receiving layer on the support.

10. A process for producing an image-recording material, comprising forming an image-recording layer by applying a coating liquid for an image-recording layer on a support, wherein the coating liquid comprises a water-dispersible emulsion of which volume-average particle size is 55 nm or more and a water-soluble polymer compound of which weight-average molecular weight (Mw) is 400,000 or less.

11. The process for producing an image-recording material according to claim 10, wherein the mass ratio of the water-dispersible emulsion to the water-soluble polymer compound (water-dispersible emulsion: water-soluble polymer compound) in the coating liquid for an image-recording layer is 1:0.01 to 1:1.

12. The process for producing an image-recording material according to claim 10, wherein the adsorbed amount of the water-soluble polymer compound in the coating liquid for image-recording layer is less than 2% by mass.

* * * * *